US006755254B2

(12) United States Patent
DeBerry

(10) Patent No.: US 6,755,254 B2
(45) Date of Patent: Jun. 29, 2004

(54) HORIZONTAL SPOOL TREE ASSEMBLY

(75) Inventor: Blake T. DeBerry, Singapore (SG)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 10/155,482

(22) Filed: May 24, 2002

(65) Prior Publication Data

US 2003/0006042 A1 Jan. 9, 2003

Related U.S. Application Data

(60) Provisional application No. 60/293,857, filed on May 25, 2001.

(51) Int. Cl.[7] ..... E21B 29/12

(52) U.S. Cl. ..... 166/368; 166/347; 166/348; 166/88.1

(58) Field of Search ..... 166/348, 368, 166/347, 88.1, 86.1

(56) References Cited

U.S. PATENT DOCUMENTS

| | | | |
|---|---|---|---|
| 3,331,437 | A | 7/1967 | Jones et al. |
| 4,629,003 | A | 12/1986 | Baugh |
| 4,853,611 | A | 8/1989 | Kislovski |
| 5,143,158 | A | 9/1992 | Watkins et al. |
| 5,299,641 | A | 4/1994 | Paulo et al. |
| 5,535,826 | A | 7/1996 | Brown et al. |
| 5,544,707 | A | 8/1996 | Hopper et al. |
| 5,992,527 | A | 11/1999 | Garnham et al. |
| 6,039,119 | A | 3/2000 | Hopper et al. |
| 6,062,314 | A | 5/2000 | Nobileau |
| 6,378,613 | B1 | 4/2002 | Kent et al. |

FOREIGN PATENT DOCUMENTS

| | | |
|---|---|---|
| WO | WO 00/47864 A1 | 2/2000 |
| WO | WO 01/73255 A1 | 3/2001 |
| WO | WO 01/73258 A1 | 3/2001 |
| WO | WO 01/73325 A2 | 3/2001 |
| WO | WO 02/097008 A2 | 5/2002 |

*Primary Examiner*—Robert E. Pezzuto
*Assistant Examiner*—Thomas A. Beach
(74) *Attorney, Agent, or Firm*—Browning Bushman

(57) ABSTRACT

A horizontal spool tree assembly 10 is provided for supporting a production tubing string 22 within a well below a BOP. The spool body 12 includes a laterally extending passageway 36 which is in fluid communication with a similar laterally extending passageway 34 provided in a tubing hanger 20. The tubing hanger includes a central bore for fluid communication with the production tubing string, and a workover flow path 30 extending axially through the tubing hanger, with a workover valve 32 provided for controlling the fluid flow in the workover passageway. An annulus port 70 extends laterally through the spool body, and an annulus valve 72 controls fluid flow through the annulus port.

79 Claims, 21 Drawing Sheets

HORIZONTAL SPOOL TREE ASSEMBLY

RELATED CASE

The present application claims priority from U.S. Ser. No. 60/293,857 filed on May 25, 2001.

FIELD OF THE INVENTION

The present invention relates to tree assemblies commonly referred to as trees, and more specifically to a tree suitable for subsea use having a spool with a lateral production port.

BACKGROUND OF THE INVENTION

Subsea wellhead assemblies and production trees are used in the oil and gas industry for recovering hydrocarbons, with the assembly conventionally supporting a production tubing within a well below a blowout preventer which defines therein a BOP bore. The blowout preventer is conventionally connected to one or more fluid lines extending from the BOP to the surface. A workover string extending from the surface to the BOP is used for fluid communication with the BOP bore. Subsea production assemblies may generally be classified as conventional or vertical production trees, single bore trees which also include vertical production, and horizontal trees. A single bore tree is disclosed in U.S. Pat. No. 5,143,158.

Horizontal trees differ from a standard Christmas tree for an oil or gas well with respect to the spool body of a horizontal tree which is connected above a wellhead housing typically mounted at the upper end of a casing string, and a tubing hanger landed within the housing to suspend a production tubing string within the casing. The spool has production and annulus valves to control fluid flow from their respective areas, and landing the tubing hanger in the spool body allows the hanger and tubing to be removed without removal of the spool body. This provides a significant advantage over more conventional trees where there is a risk of having to pull the tubing, since the valves located on the tree provide access to the production and annulus bores once the tree is installed. Additional valves are required during the installation phase to allow access to the tubing/casing annulus after the tubing hanger is landed and sealed to the tree body.

Commercially available horizontal trees include at least three ports from the spool body: a production port for production fluid; an annulus port for communication between the production tubing and the wellhead housing, and a workover port in communication with the BOP bore, and thus with the workover string extending to the surface.

U.S. Pat. Nos. 5,544,707 and 6,039,119 disclose horizontal tree assemblies. Other patents of interest include U.S. Pat. Nos. 4,853,611; 5,465,794; 5,555,935; 5,582,438; 5,706,893; 5,730,473; 5,749,608; 5,865,250; 5,868,204; 6,050,339; 6,062,314; 6,119,773; 6,158,716; 6,244,348 and 6,302,212. Another version of a horizontal spool tree assembly is depicted on page 44 of the Dril-Quip 2000 General Catalog. U.S. Pat. No. 6,378,613 discloses a Christmas tree and tubing hanger system. Other relevant publications directed to oilfield technology, including gate valves, include WO 01/73258; WO 01/73255; WO 00/47864; WO 01/173325 and WO 01/81801.

SUMMARY OF THE INVENTION

A horizontal spool tree assembly is provided for supporting the production tubing string within a well below a blowout preventer defining the BOP bore. The blowout preventer is connected to one or more fluid control lines extending from the BOP to the surface. A workover string may be used for fluid communication between the BOP bore and the surface. The tree assembly includes a spool body for positioning below the BOP and defining a spool body central bore for receiving a tubing hanger. The spool body has a lateral production passageway extending laterally from the central bore to a production valve, i.e., a horizontal tree. The tubing hanger is sealed to the spool body and adapted for supporting the production tubing string therefrom. The tubing hanger preferably includes a tubing hanger central bore in fluid communication with the interior of the tubing string and a lateral tubing hanger production passageway extending laterally from the tubing hanger central bore for fluid communication with the lateral bore in the spool body. A workover flow path is provided extending axially through the tubing hanger from the spool body central bore below the tubing hanger to the spool body central bore above the tubing hanger, thereby providing fluid communication with the workover string to an annulus below the tubing hanger and surrounding the production tubing string. A workover valve is positioned within the workover flow path for controlling fluid flow between the bore in the spool body above the tubing hanger and the annulus below the tubing hanger and surrounding the production tubing string during a workover operation.

It is a feature of the tree assembly that the spool body may also include an annulus port in a spool body extending laterally from an annulus surrounding the production tubing to an annulus valve. The spool body may also include a crossover port extending laterally through the spool body above the tubing hanger, a crossover flow line extending from the crossover port to the production valve, and a crossover valve for controlling fluid flow along the crossover flow line.

It is a further feature of the invention that the production valve may be positioned within the spool body. Yet another feature of the invention is that the workover valve positioned along the workover flow path in the tubing hanger may be a valve for holding pressure in either direction.

Yet another feature of the invention is that the tree assembly may include a safety valve positioned along the production tubing string below the tubing hanger. The tree assembly may also include a first closure member positioned within the central bore in the tubing hanger, and a second closure member positioned above the tubing hanger for isolating the BOP bore from the crossover port in the spool body. The second closure member may thus be positioned between the first closure member and the BOP bore for isolating the first closure member from the BOP bore.

A significant advantage of the present invention is that components which make up the assembly are highly reliable. By providing a workover flow path extending axially through the tubing hanger, the body of the spool tree acts as another barrier to fluid flow, which is lacking for embodiments wherein the spool body includes a laterally extending workover port. In the vicinity of the production passageway in the spool body, a first barrier for workover fluid is the body of the tubing hanger itself, while the second barrier is the spool body. As a further advantage of the invention, the tree assembly may be used with conventional equipment commonly related to wellhead assemblies, including safety valves and closure members.

A related advantage of the production assembly is that fewer valves may be required compared to prior art production assemblies, especially outboard of the tree body.

These and further objects, features, and advantages of the present invention will become apparent from the following detailed description, wherein reference is made to the figures in the accompanying drawings.

BRIEF DESCRIPTION OF THE DRAWINGS

FIGS. A1–A7 depict one embodiment of a horizontal spool tree assembly in various positions and flow paths for different phases of operation.

FIGS. B1–B7 disclose a second embodiment of a horizontal spool tree assembly in different phases of operation.

FIGS. C1–C7 disclose a third embodiment of a horizontal spool tree assembly in different phases of operation.

DESCRIPTION OF THE PREFERRED EMBODIMENTS

There are disclosed below three embodiments of the improved horizontal tree assembly constructed in accordance with this invention. Each assembly 10 is shown in the different stage of operation, as will be described, and includes a spool body 12. The valves and other closure members for controlling fluid flow are schematically indicated by an X within a square, with the X indicating the valve is closed and a circle within the square indicating that the valve is open. The fluid flow in the various flow paths will depend on the function being performed, e.g., production fluid, test fluid, flushing fluid, gas lift, etc.

Figure 1A:
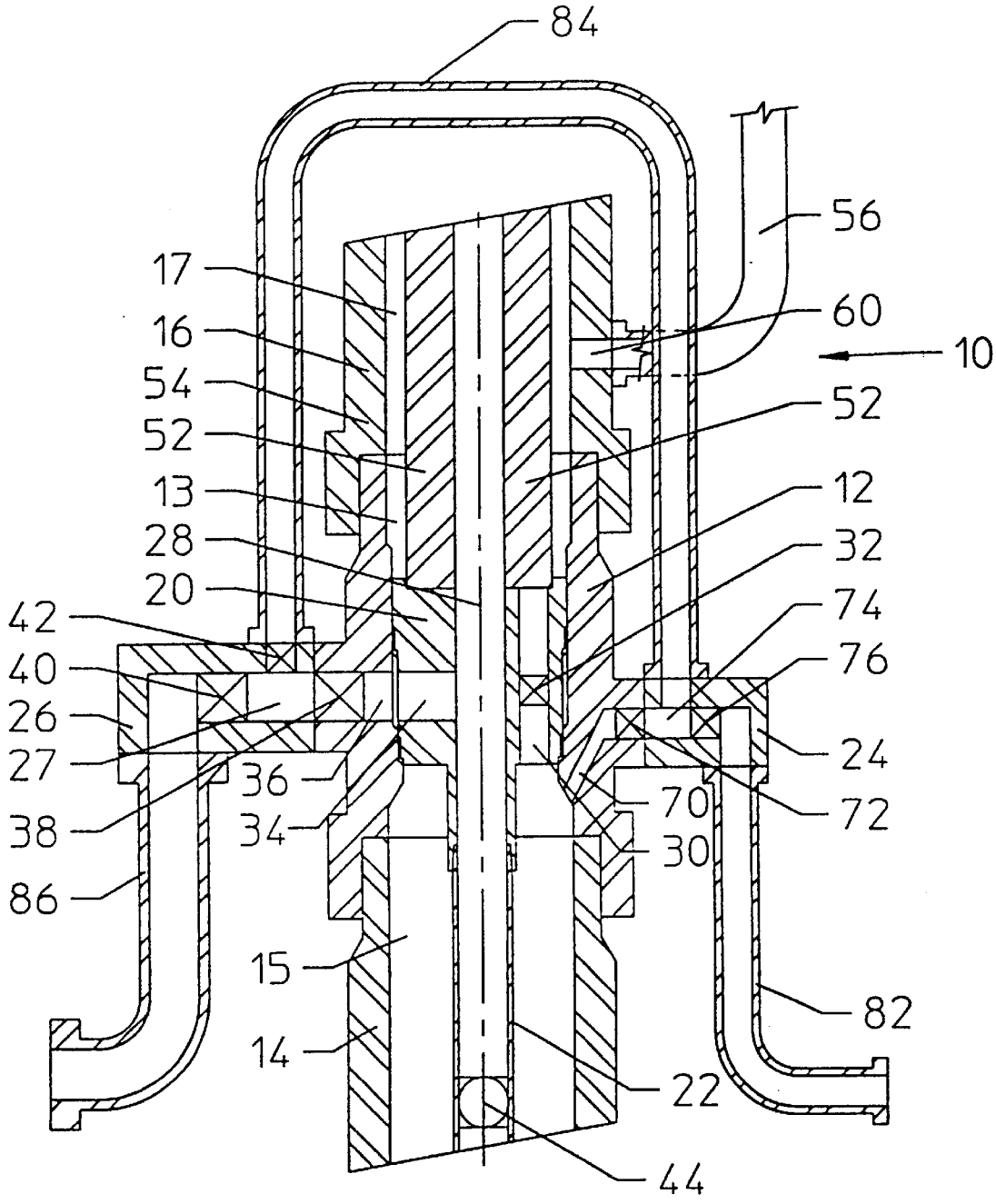
Figure 1B:
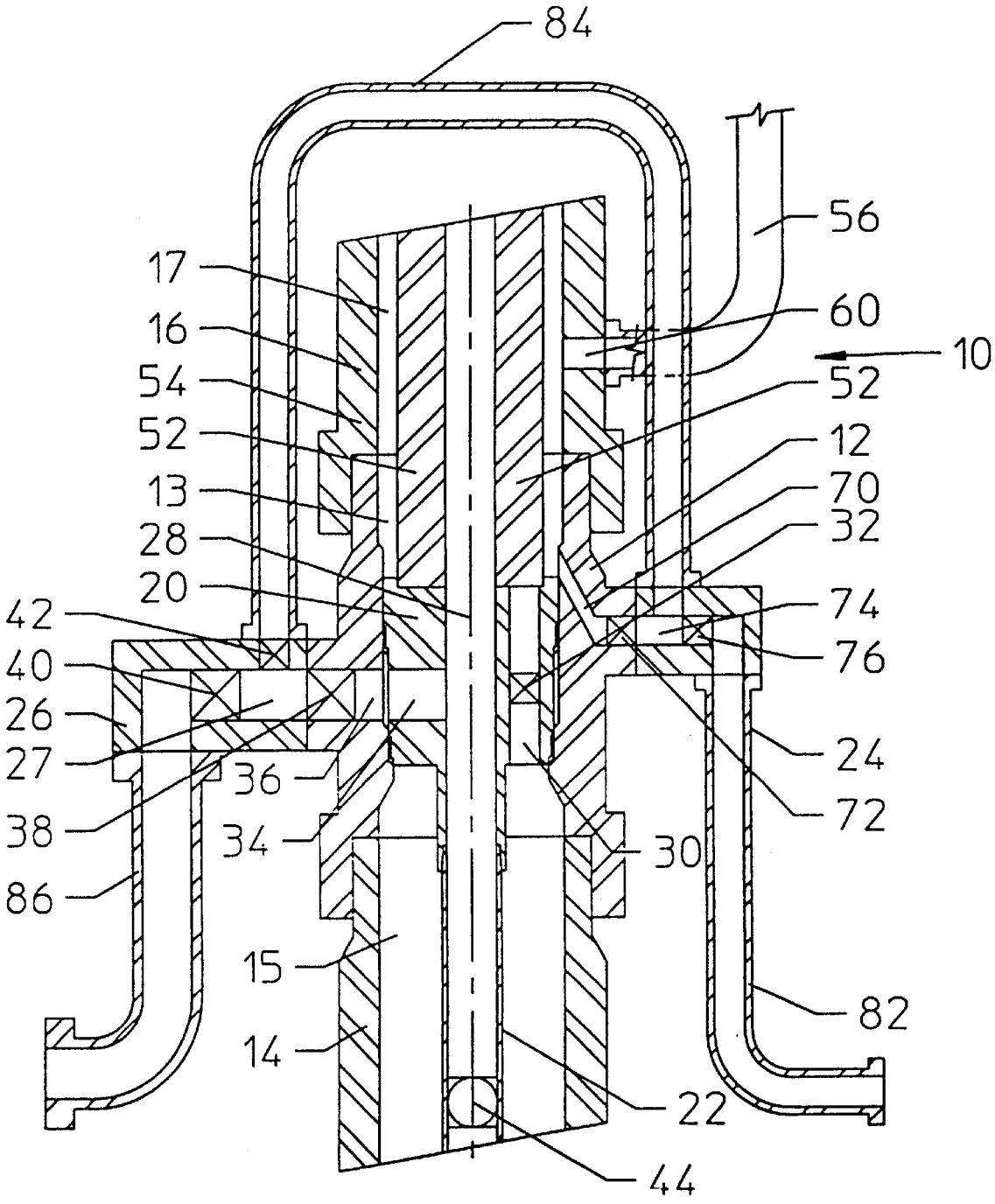
Figure 1C:
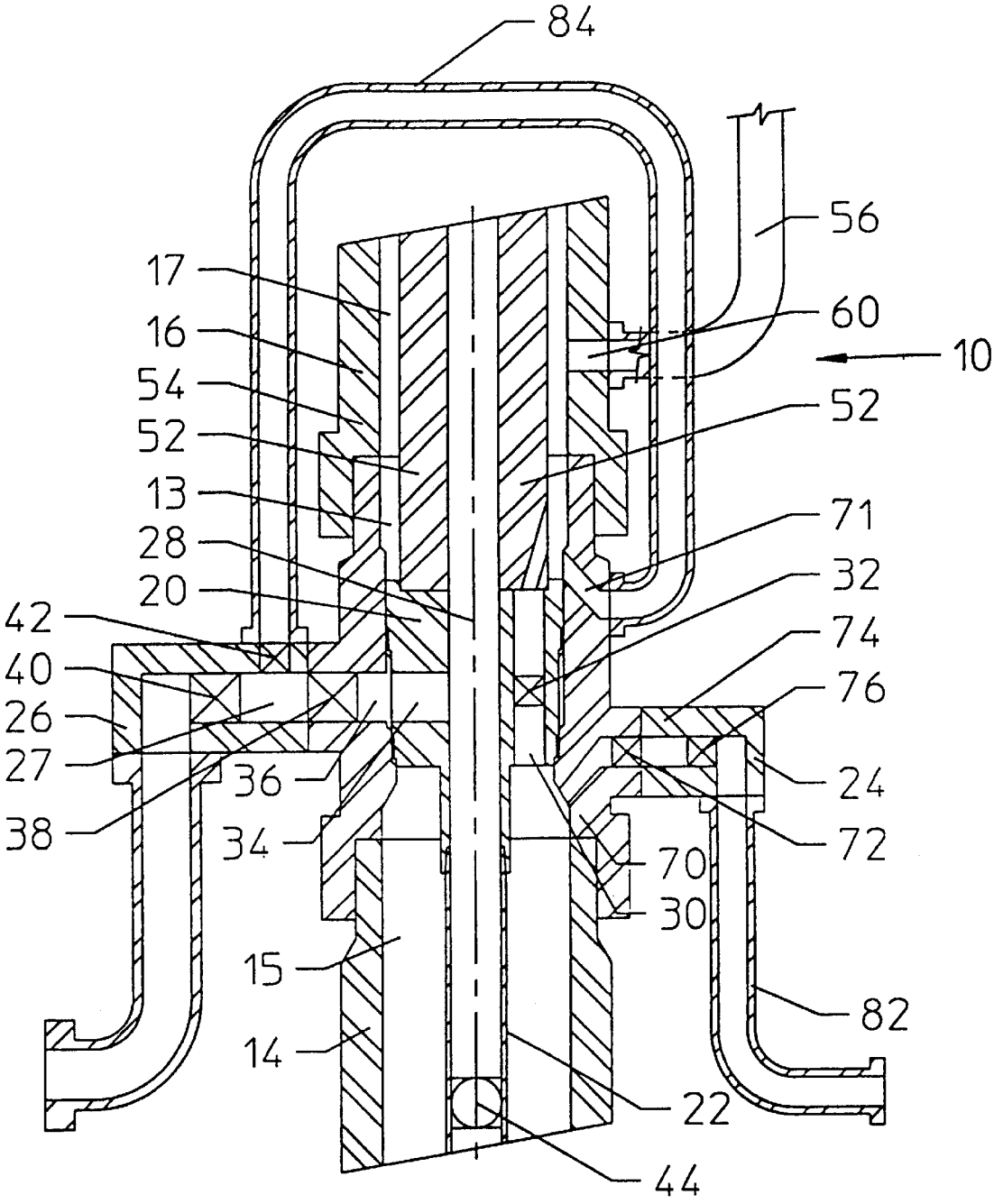

As shown in FIG. 1, a wellhead housing 14, spool or spool body 12 above the wellhead housing, and the blowout preventer (BOP) stack 16 above the spool 14 are connected with their respective bores 15, 13, 17, which preferably are axially aligned. The wellhead housing 14 may be conventionally located on the subsurface level of a subsea well and may be connected to the upper end of a casing string (not shown) extending into the subsurface. The upper end of the BOP stack 16, on the other hand, is conventionally connected to a riser pipe (not shown) which extends upwardly to the surface. In alternate embodiments, the tree could be used in a land-based application, and in some applications the casing may be omitted.

In the drawings, the horizontal tree is shown following the running and landing of casing within the wellhead housing, with the tubing hanger 20 landed and supported in a bore 13 of the spool body 12 for suspending a production tubing string 22, which conventionally may extend through a casing hanger and into the well.

In each of the three embodiments, the tubing hanger 20 is releasably supported within and sealed to the bore of the spool body 12, and has a vertical bore 28 therethrough whose lower end is in fluid communication with the production tubing string 22. The upper end of the bore 28 opens to the bore 13 of the spool body 12 above the hanger 20 (assuming the running tool is removed), and thus with a space within the bore beneath the tree cap when the cap is in place. As shown, there is a parallel vertical passageway 30 through the hanger 20 to one side of its central bore 28, and a workover valve 32 is installed therein. The passageways and the valve positions of the tree assembly serve different functions, depending on the phase.

Seven different phases of operation are thus depicted for the three embodiments. Thus, for example, FIGS. A3, B3, and C3 each show the tree and its associated parts in position to flush flow lines 82, 84, 86 extending from the left and right-hand lateral extensions or blocks 24 and 26 on opposite sides of the spool body 12. The crossover conduit 84, as shown in the figures with an inverted U shape, forms a crossover flow path connecting at its lower left end with a passageway 27 in the left lateral extension or production block 26, which is in communication with the first and second lateral ports 34, 36 in the tubing hanger 20 and spool tree body 12, respectively. The outer end of the passageway 27 of the block 26 is shown in fluid communication with the upper end of the production flow line 86. In all three embodiments, the production valve 38 is provided, preferably within the lateral passageway in the spool body 12, or in a separate block such as block 26, for controlling flow from the passageway 36 to the production line 86, and preferably is positioned upstream from the crossover line 84. A second production isolation valve 40 is also provided in the production block 26. A crossover valve 42 is provided at the end of the crossover line 84 for fluid communication with the passageway 27 in the block 26 and between the production valves 38 and 40. As previously noted, the workover valve 32 is installed in the bore 30 in the tubing hanger 20. Valves 72 and 76 will be discussed below.

A subsurface safety valve (SSSV) 44 is shown conventionally installed in the tubing string 22 beneath the hanger. Valve 44 is normally open, but may be closed in response to one or more predetermined conditions. FIGS. A5, B5, and C5 depict a production string sliding sleeve 47 installed as part of the tubing to permit the injection of gas into the production fluid during gas lift production flow, usually below the SSSV.

Figure 2A:
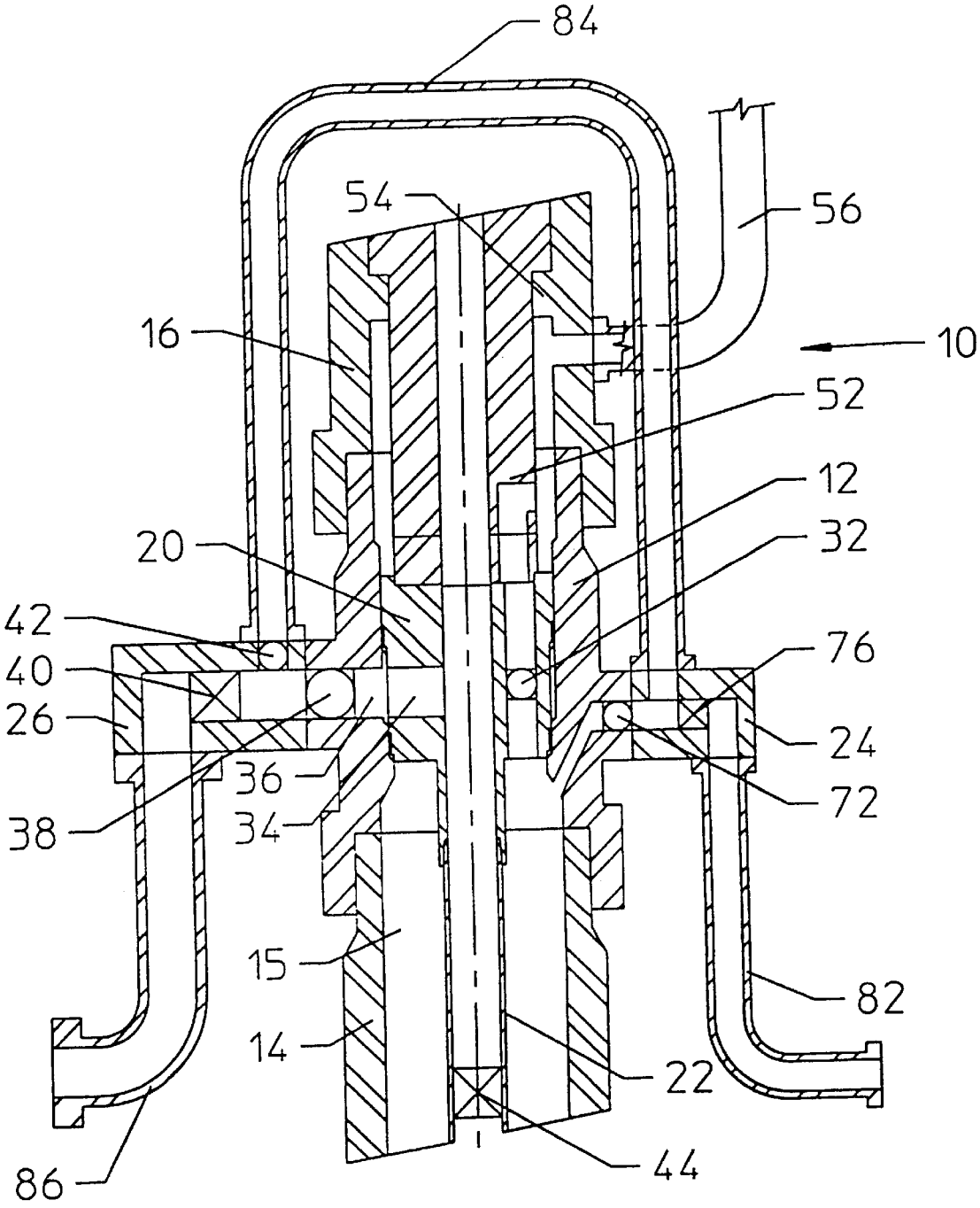
Figure 2B:
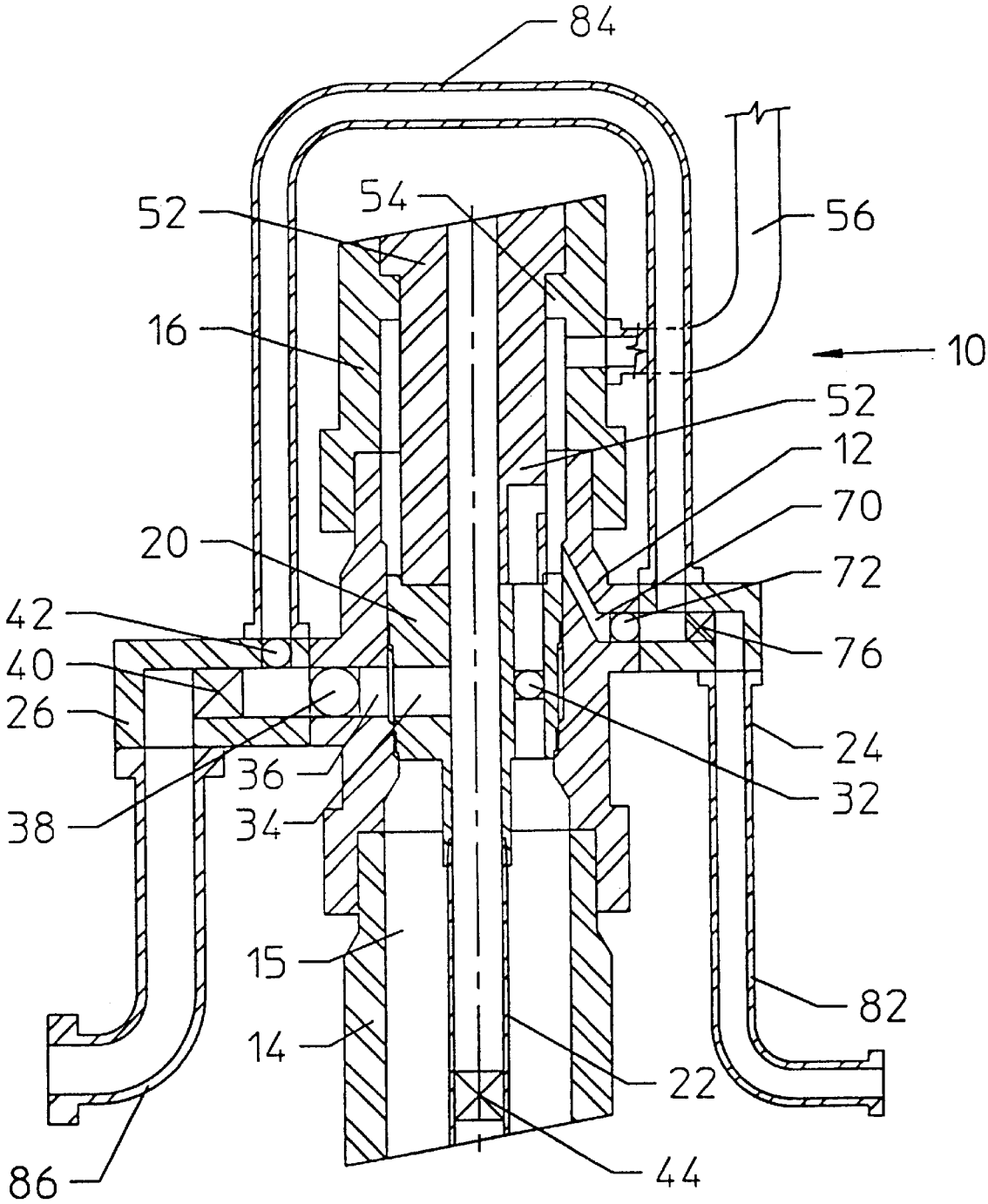
Figure 2C:
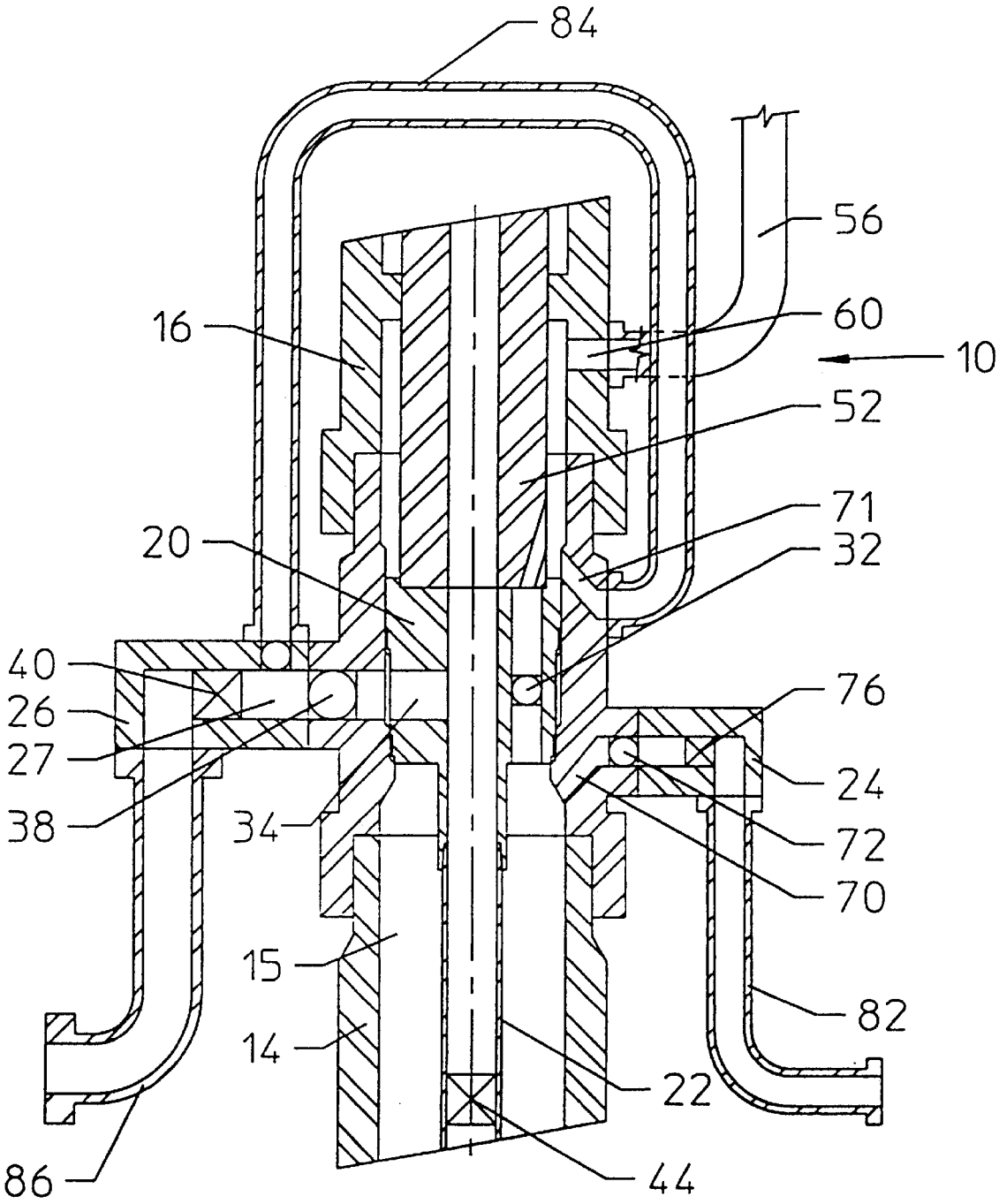
Figure 3A:
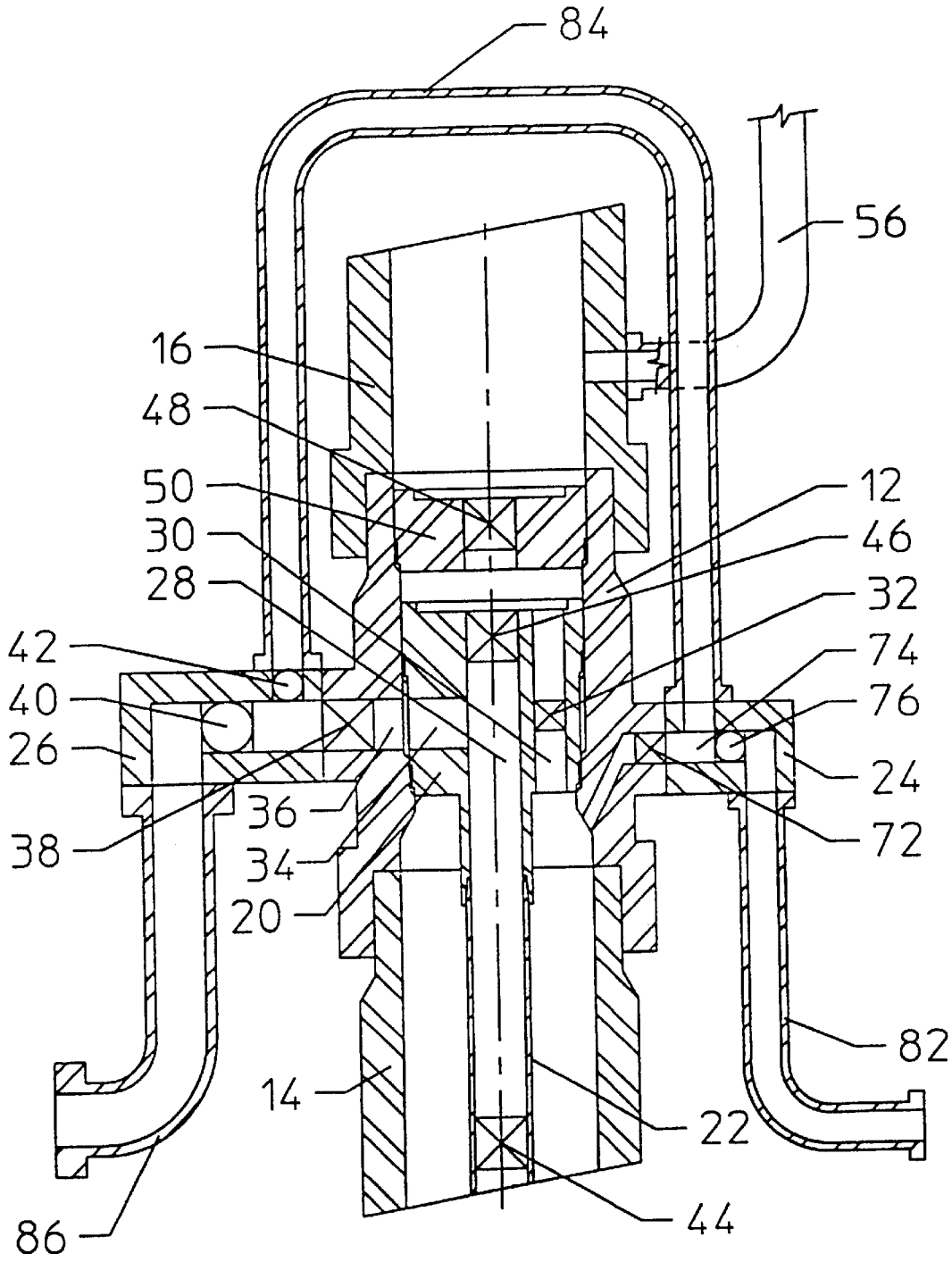
Figure 3B:
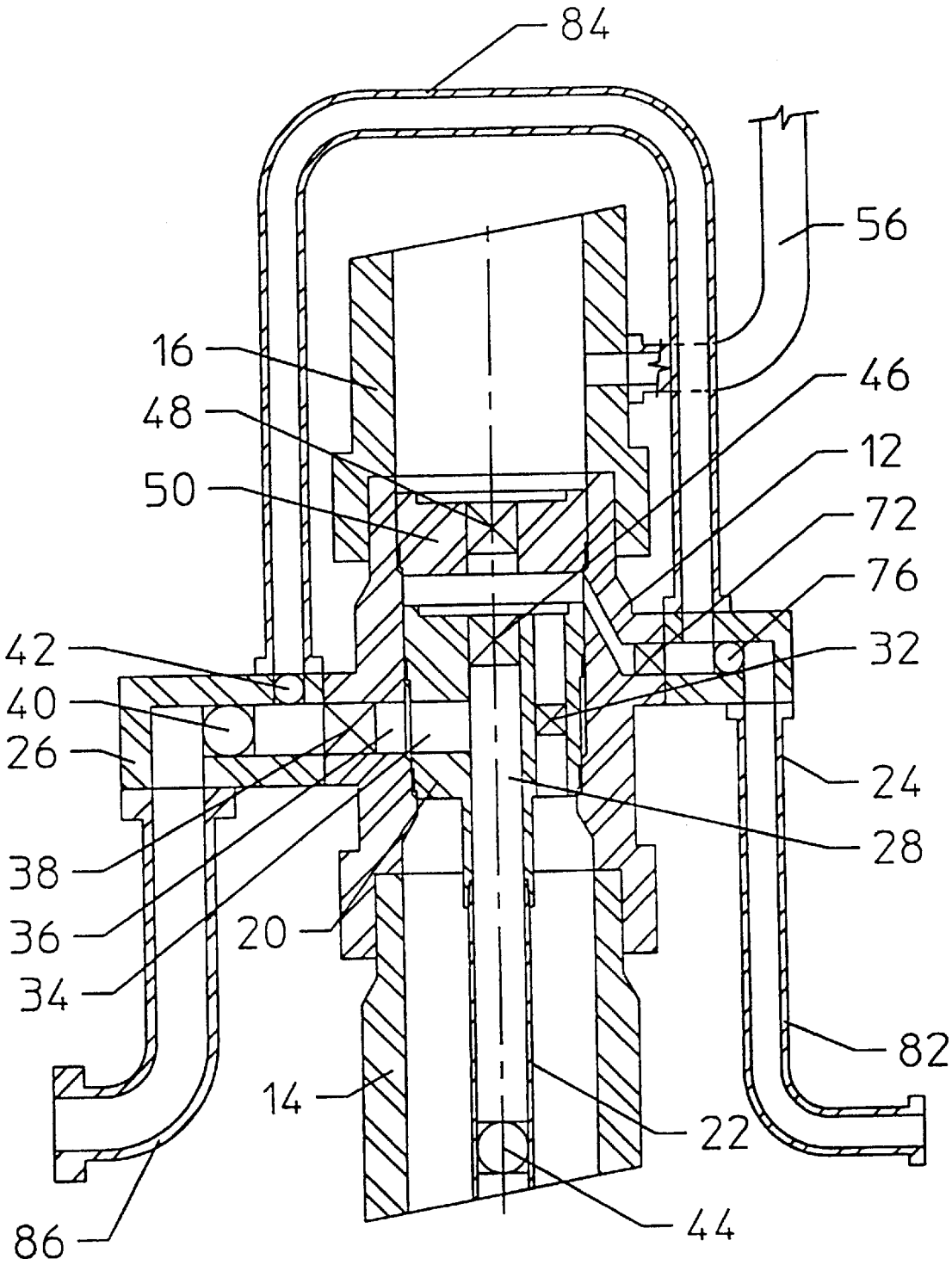
Figure 3C:
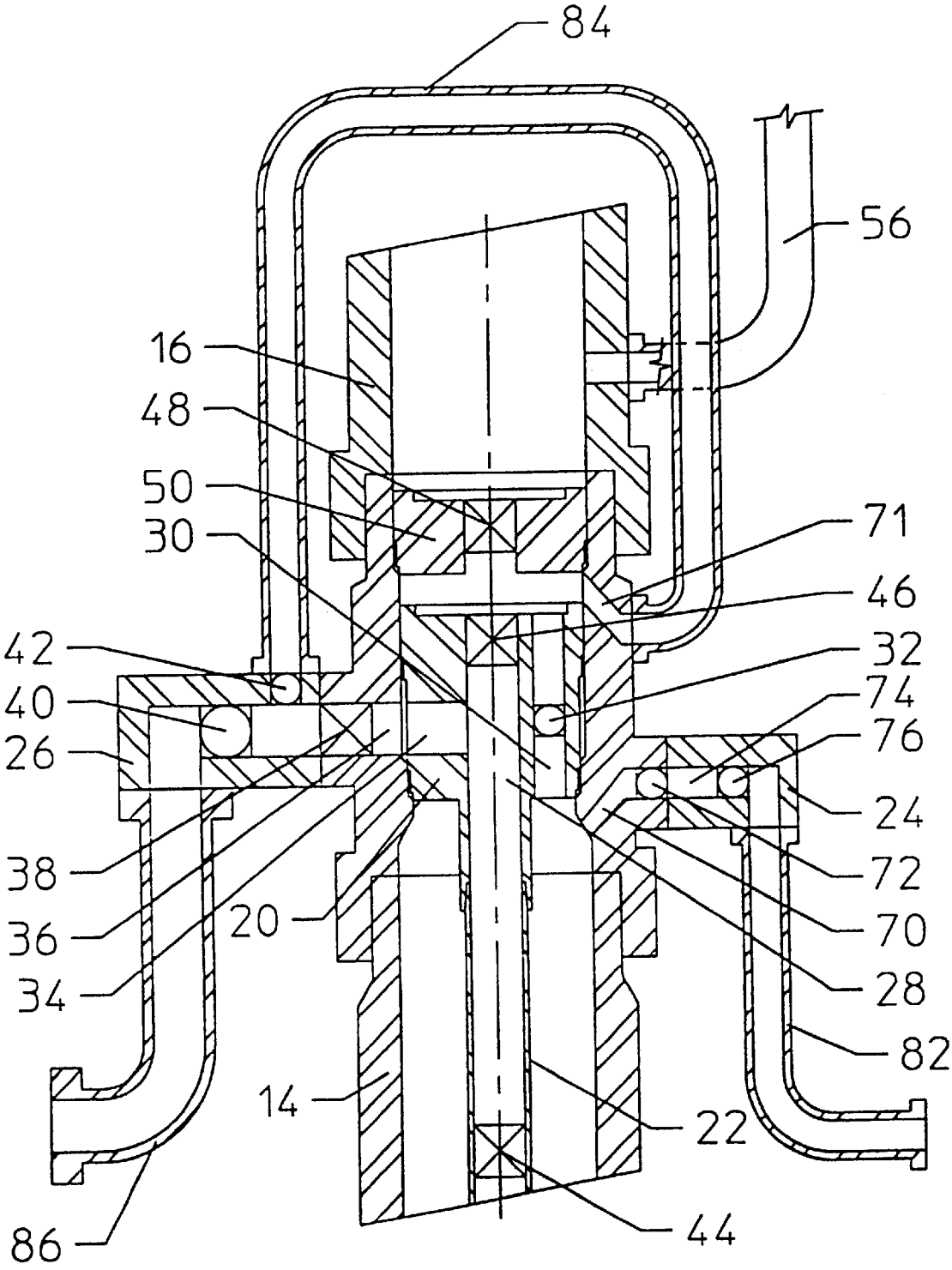
Figure 4A:
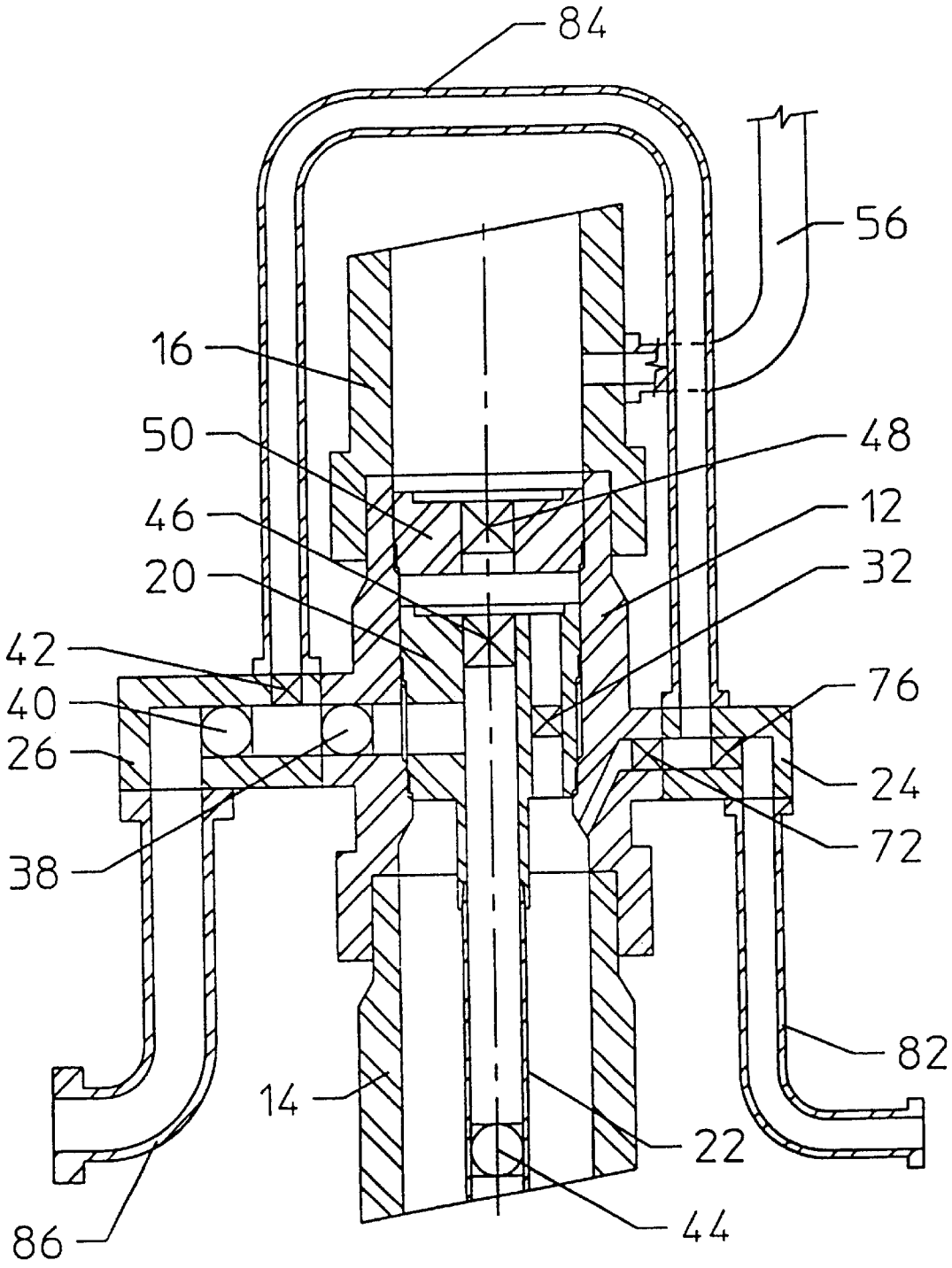
Figure 4B:
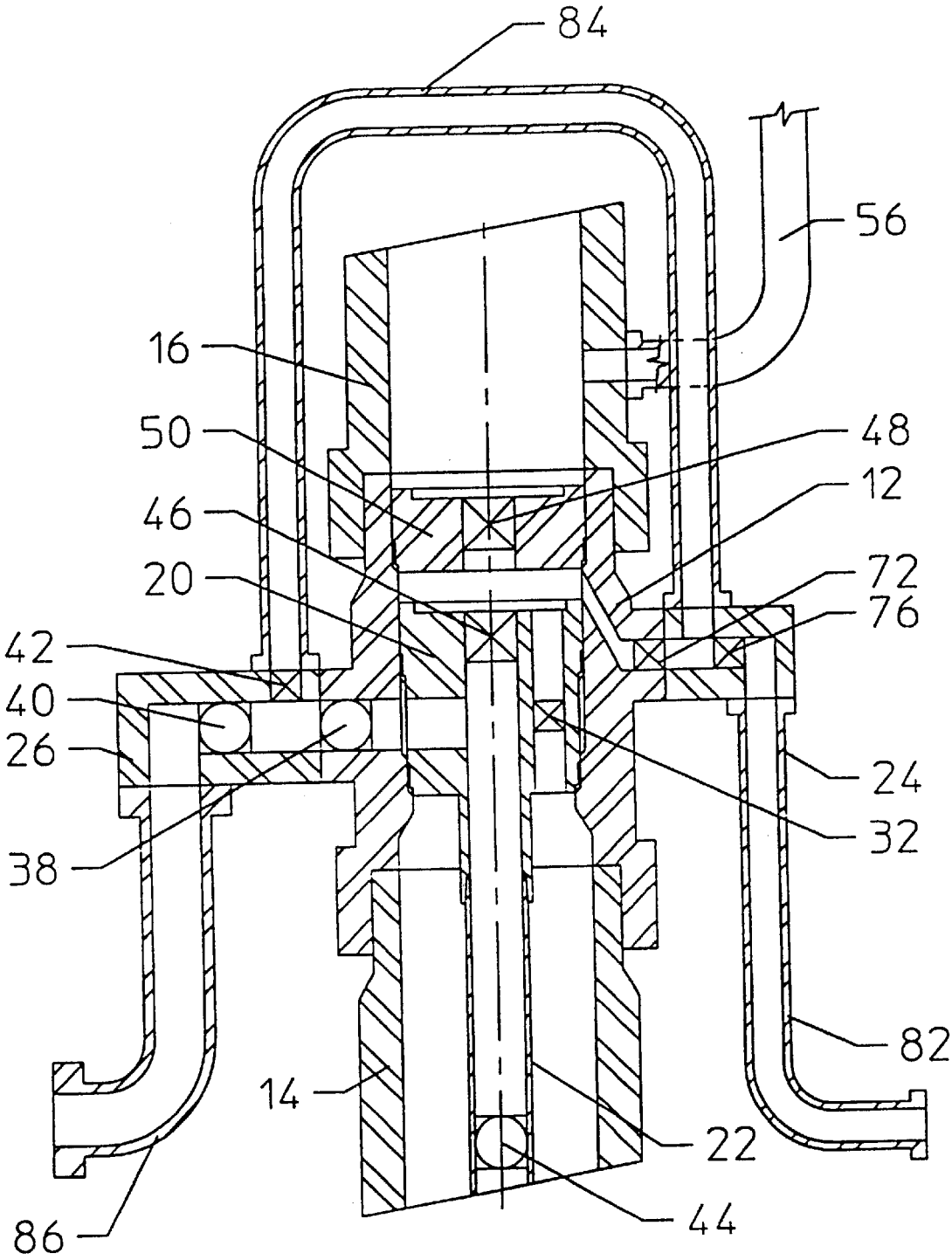
Figure 4C:
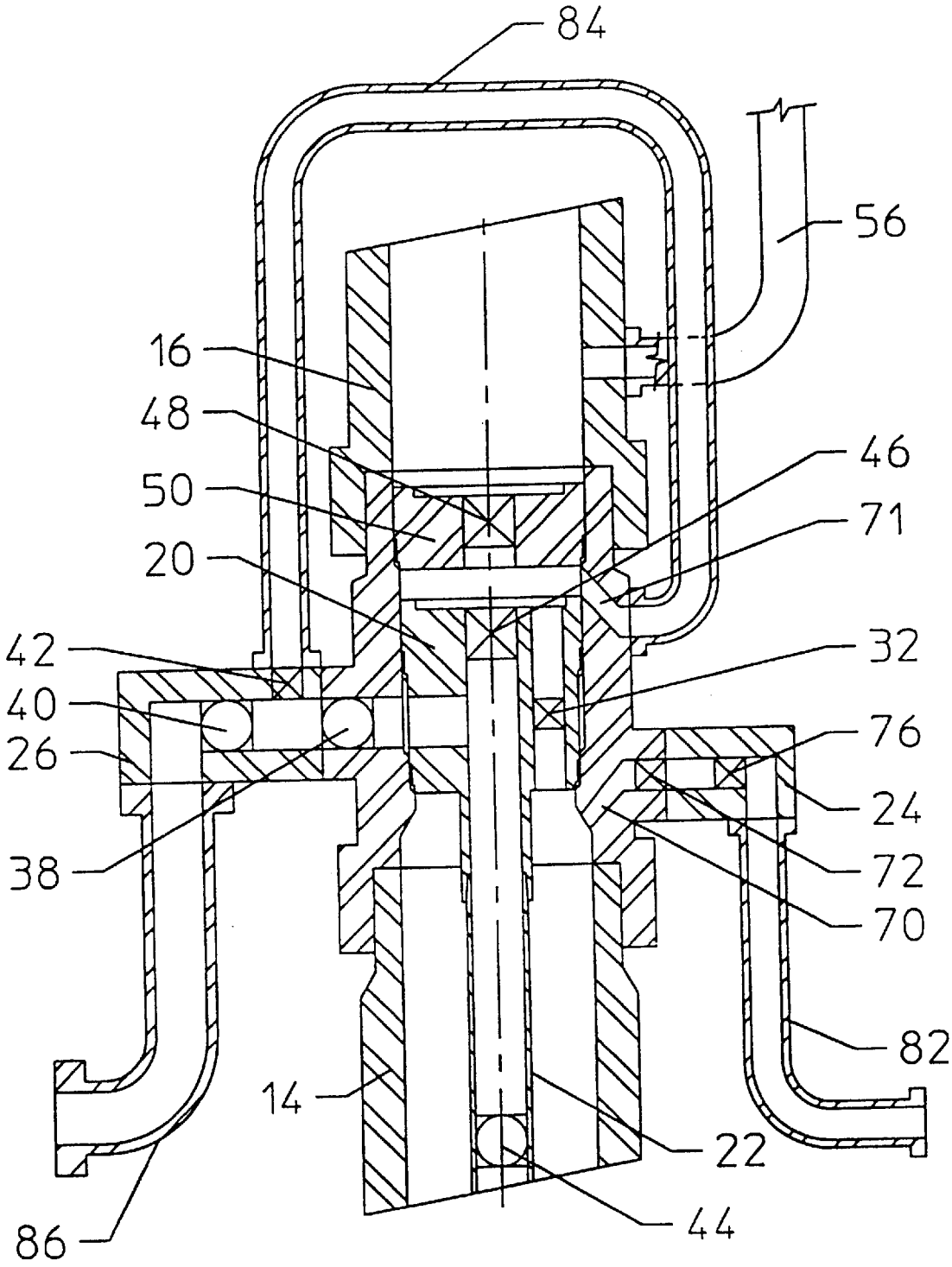
Figure 5A:
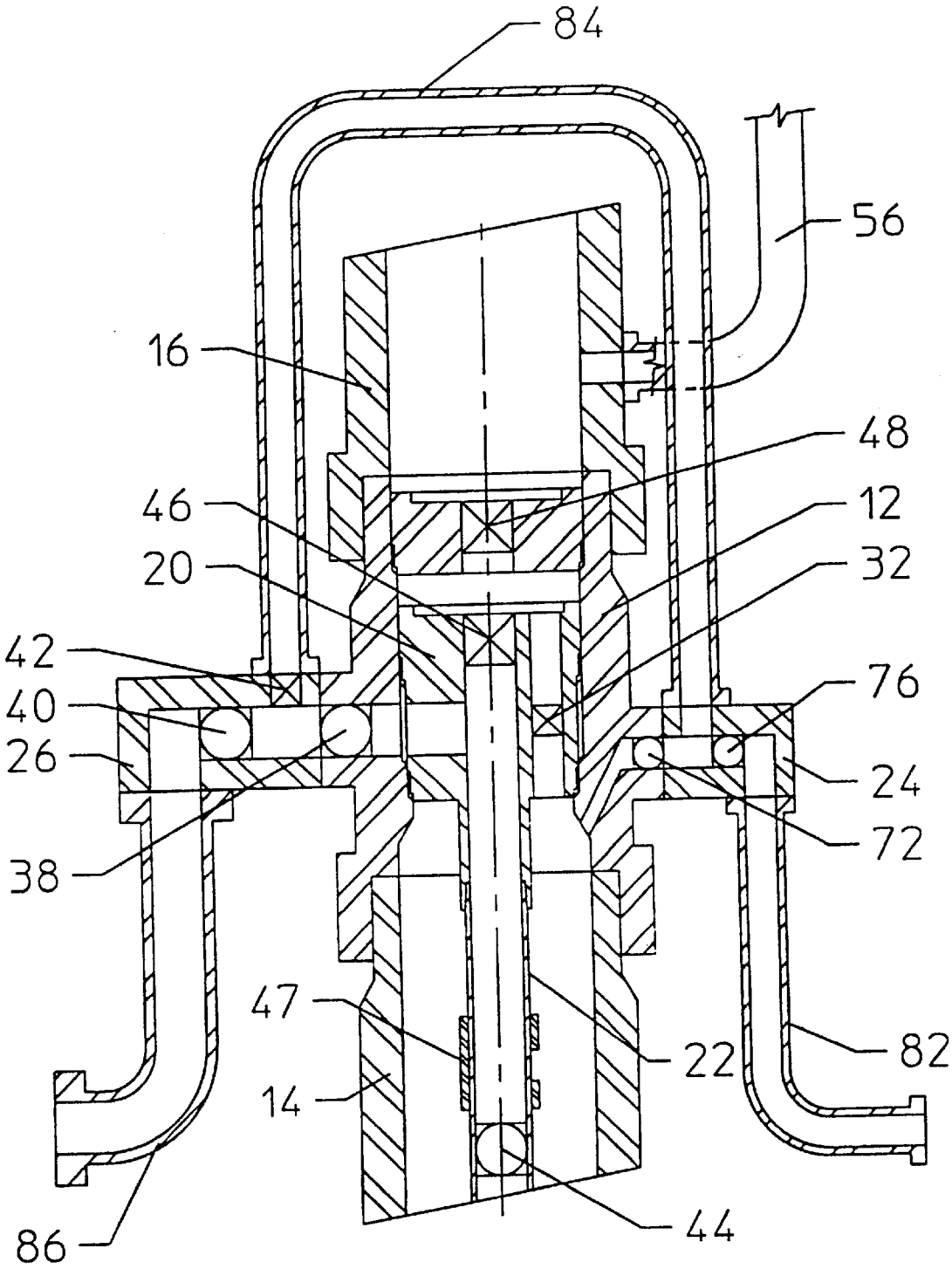
Figure 5B:
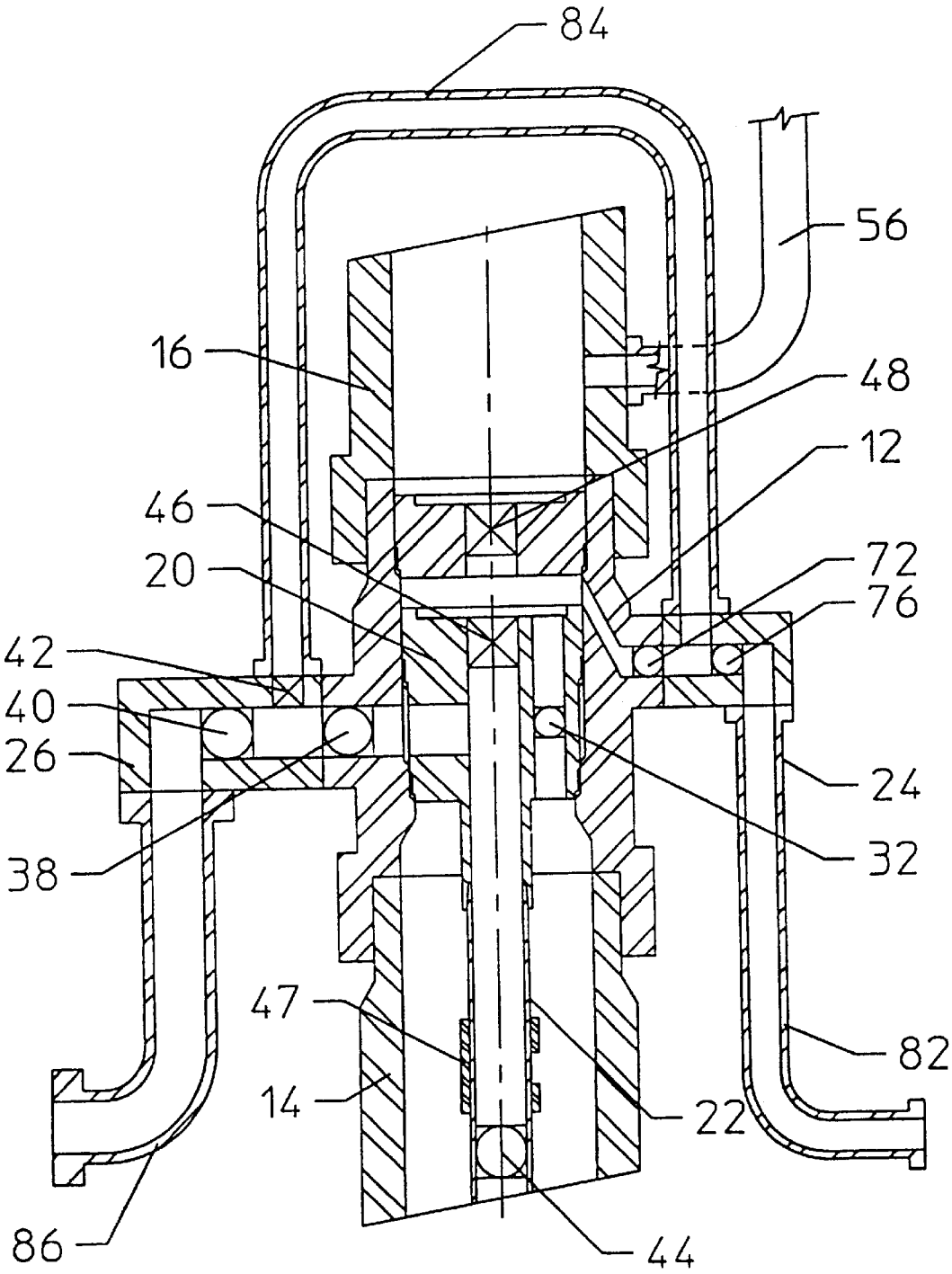
Figure 5C:
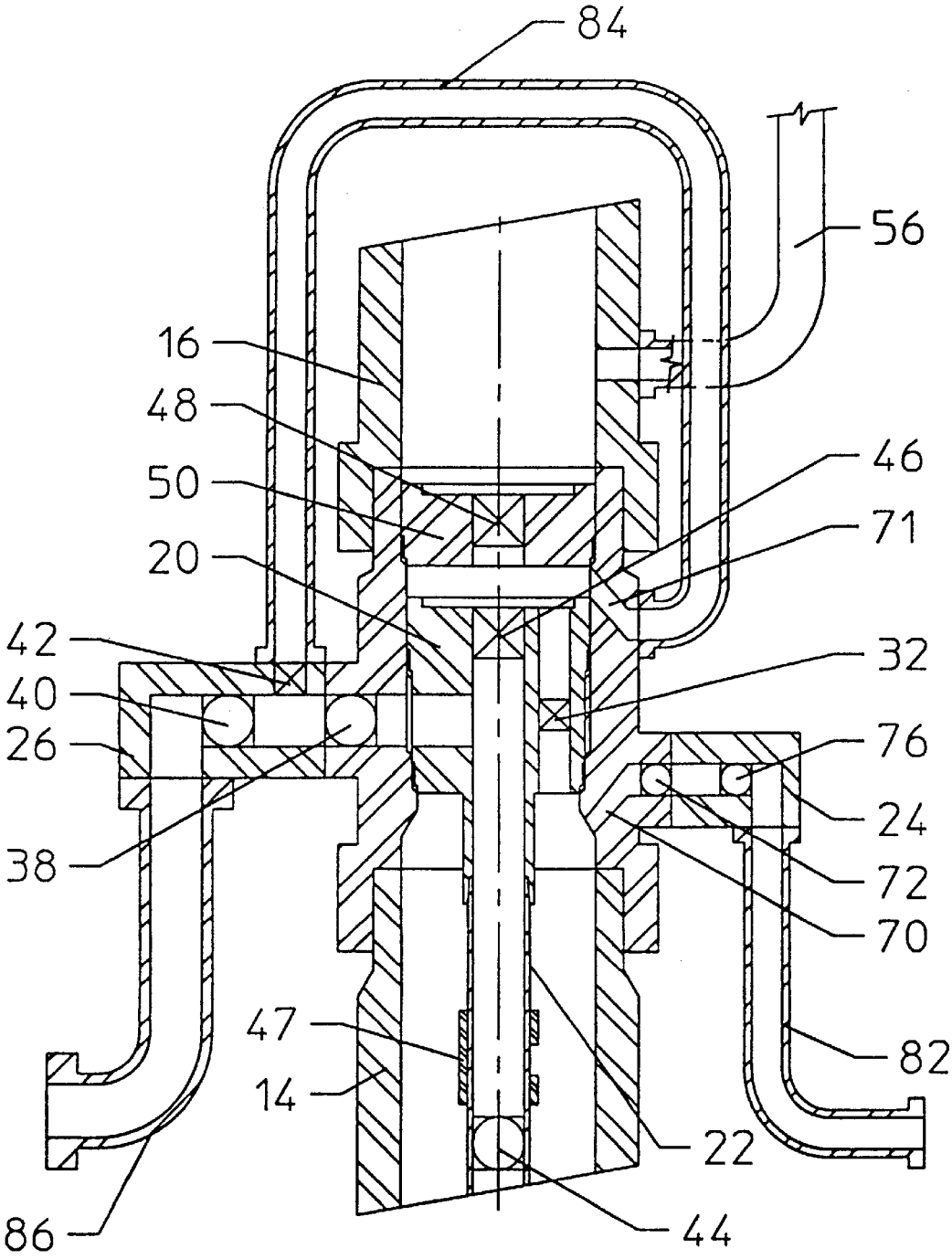
Figure 6A:
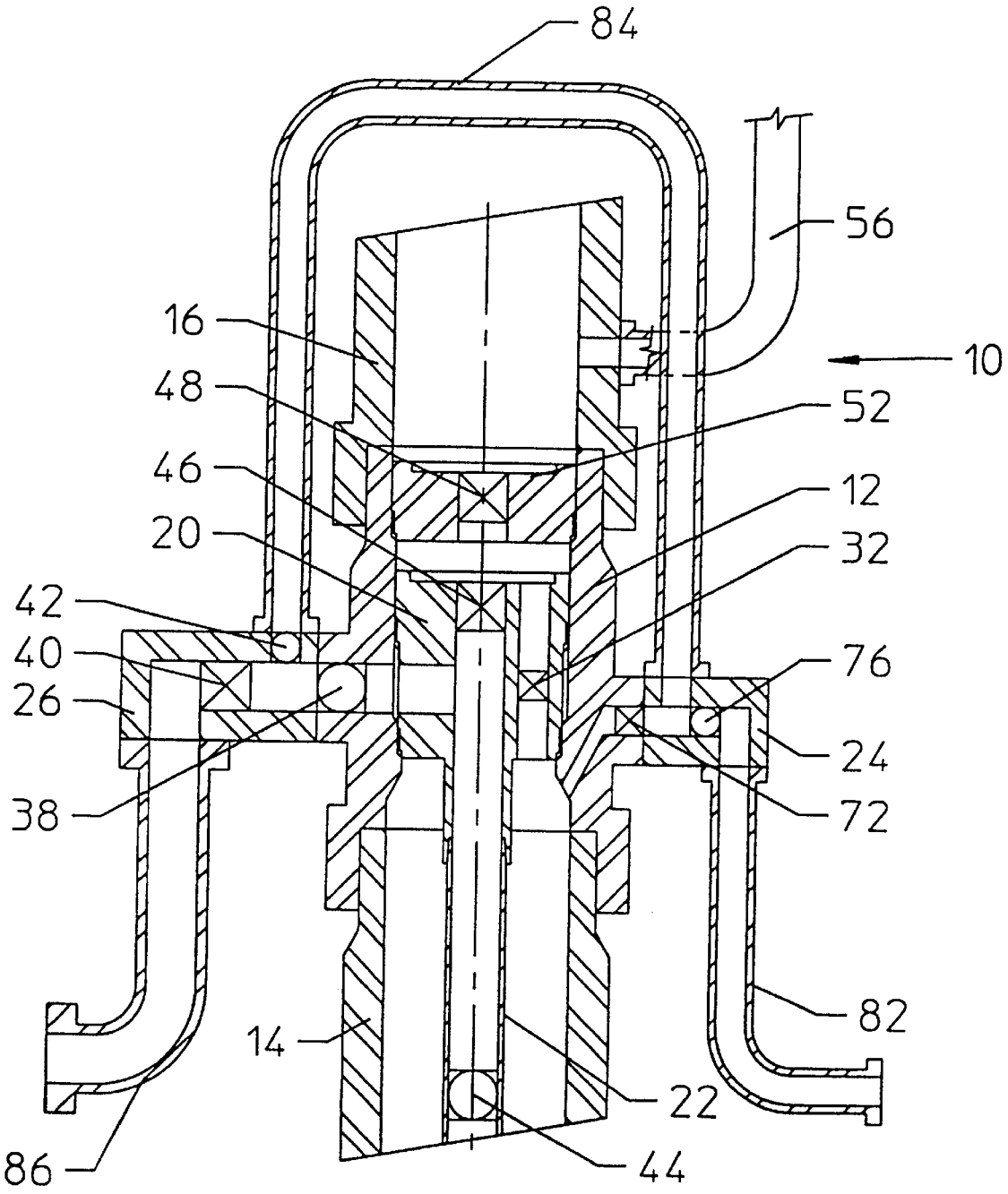
Figure 6B:
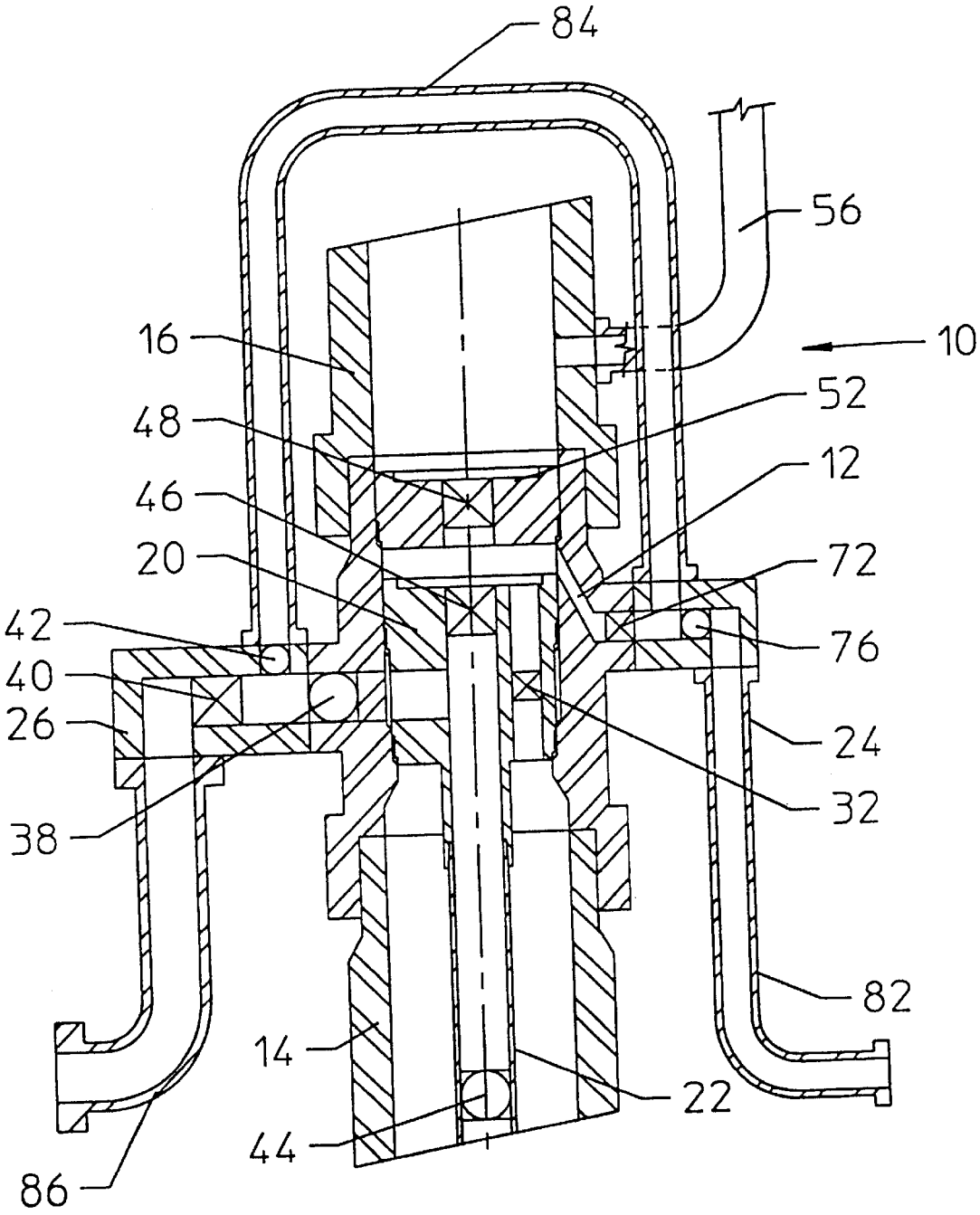
Figure 6C:
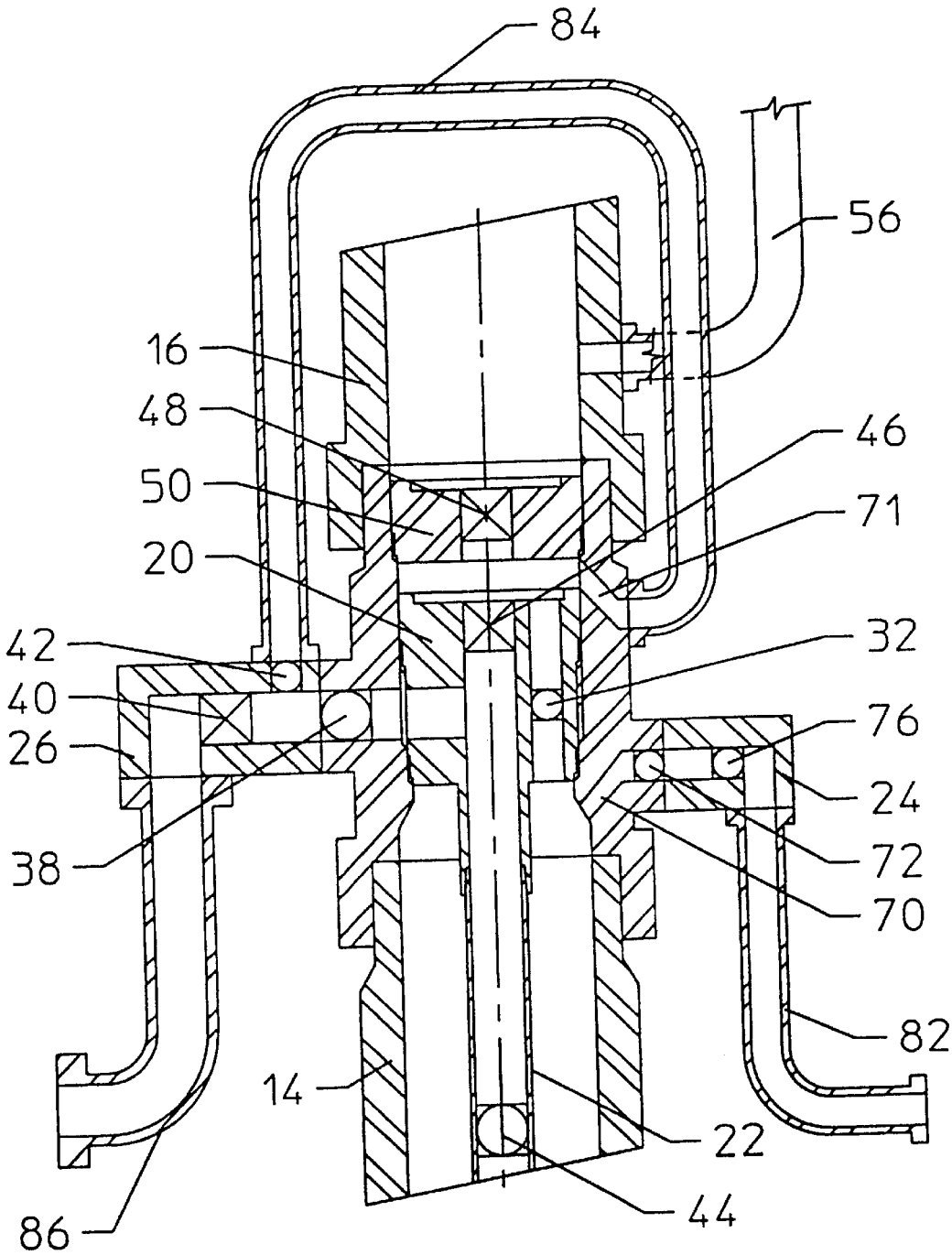
Figure 7A:
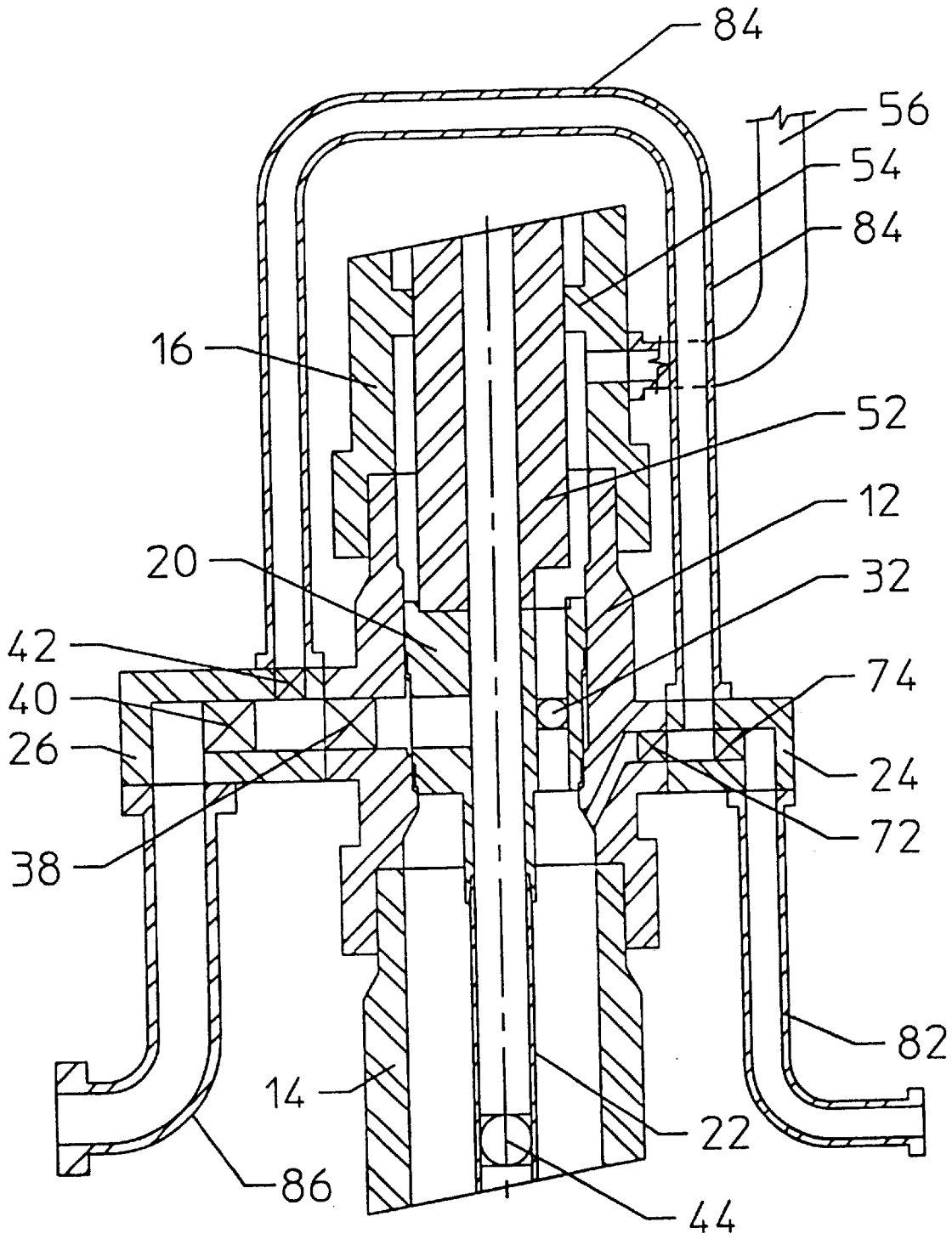
Figure 7B:
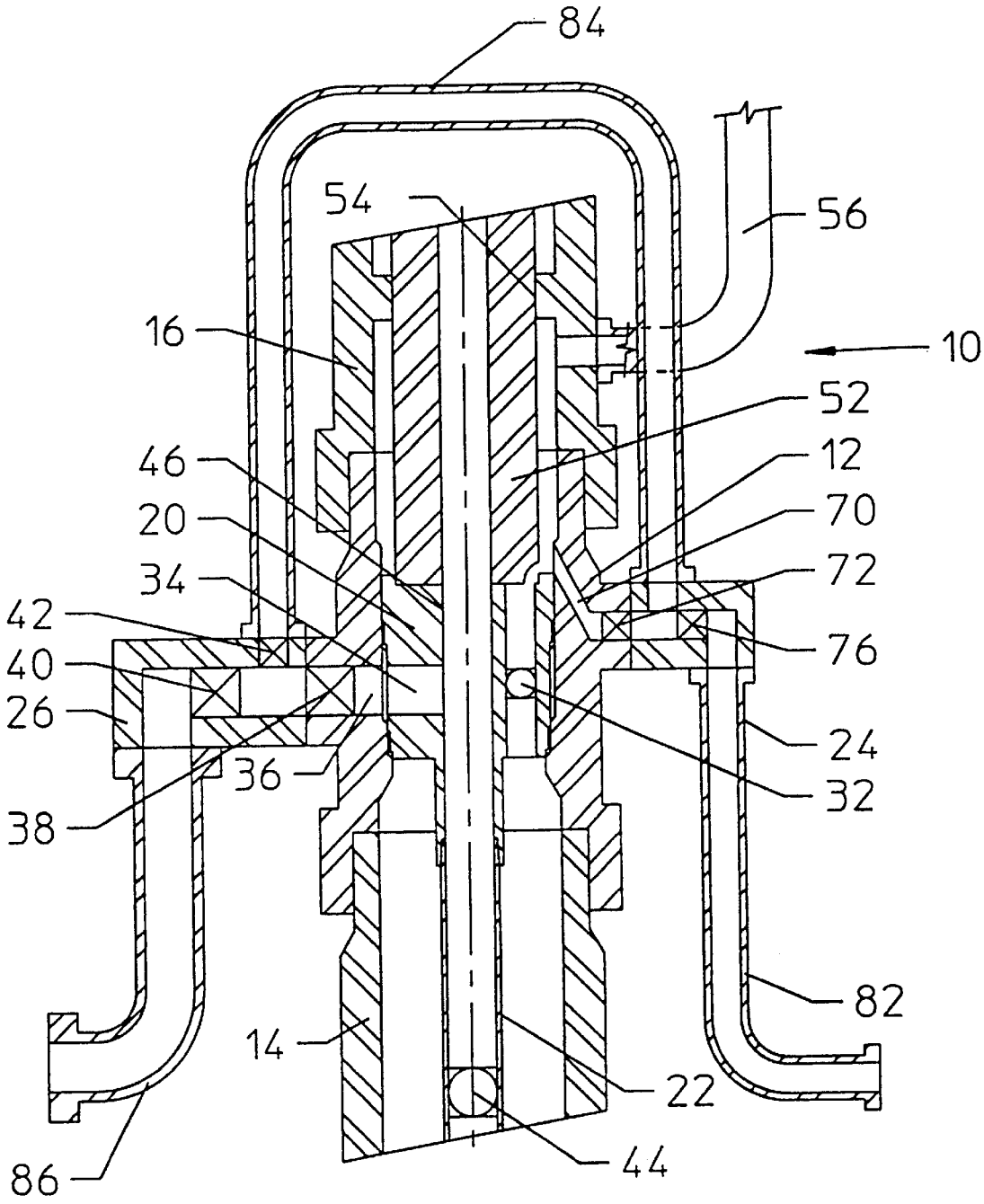
Figure 7C:
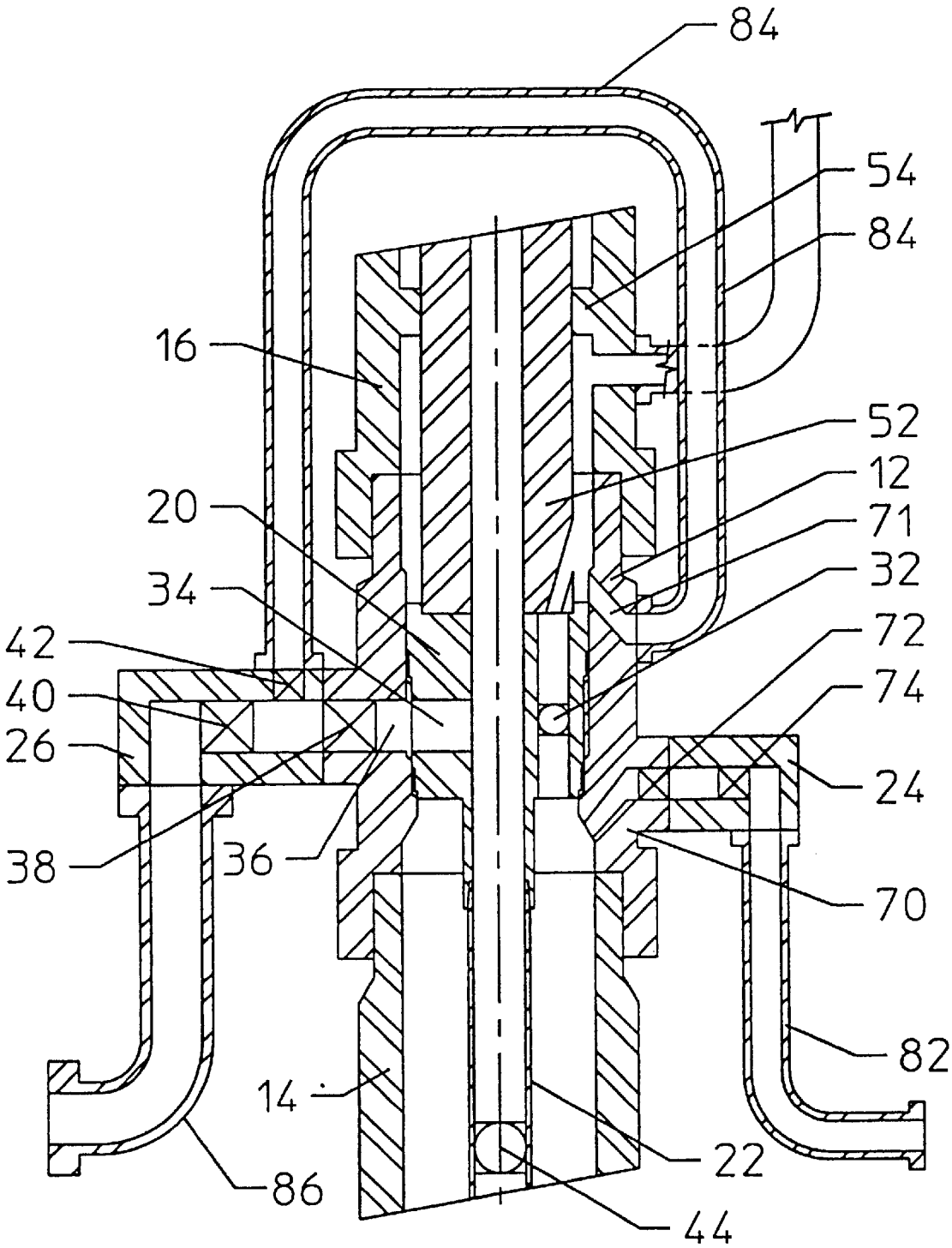

Each of the three embodiments may be used in various modes of operation, including the flow test FIG. 1, the flush running string FIG. 2, the flush flow lines FIG. 3, the production flow FIG. 4, the gas lift production flow FIG. 5, the production crossover flow FIG. 6 and the workover flow FIG. 7 modes. The valves and passageways in the tree assembly perform different functions, depending in some cases on the embodiment, and the valves are controlled to perform their respective functions, as discussed below. Each embodiment includes a lateral port in the tubing hanger in communication with the production port and the lateral port in the spool body, a bore in the spool body, and a vertically extending workover passageway in the spool body, with a valve in the tubing hanger for controlling flow in either direction along the workover passageway. The valves are thus adapted to be opened or closed, as illustrated in the figures.

FIG. 3 of each embodiment depicts a first closure member 46 along the central bore 28 of the tubing hanger 20, and also illustrates a tree cap 50 with a second closure member 48 within a vertical bore in the tree cap. The first closure member may be a tubing hanger wireline plug, but in other embodiments could be another type of valve or closure within the central bore in the tubing hanger. Similarly, the tree cap 50 may be provided with various types of closure members, including seats for sealing engagement with wireline plugs.

FIG. 1 illustrates each of the plugs 46 and 48, as well as the tree cap 50, removed from within the bore of the spool 12, and a tubing hanger running tool 52 positioned at the end of a running string for cooperation with the tubing hanger 12 during a flow test or other function. FIG. 2 shows the tree assembly during flushing of the running string, and also illustrates conceptually the rams 54 of the BOP stack 16 closed about the running tool 52 above the connection for a choke and kill control line 56. Various choke and kill lines may be provided to a subsea tree. The BOP body 16 may thus be provided with one or more side ports 60 for fluid communication between a respective line 56 and the interior of the spool body 12 above the tubing hanger. A workover string, such as a tubing string, may also be used for conducting workover operations, as discussed below.

The first closure member 46 as shown in FIG. 3 may be installed in the vertical bore of the tubing hanger, while the lateral port 34 in the tubing hanger beneath the closure 46 is in fluid communication with the lateral port 36 in the spool body 12. The second closure member 48 is removably and sealingly installed in a bore in the tree cap 50, and is sealed to the tree cap to form a sealed chamber within the spool 12 below the tree cap. Both the plugs 46 and 48 may be installed and retrieved by wireline.

The spool body 12 conventionally also includes an annulus port 70 which extends laterally through the spool body 12, and typically is slanted so that the entry to port 70 is either above or below the tubing hanger, and is shown below the tubing hanger (technically below the seal between the tubing hanger and the spool body) in the A and C embodiments, and above the tubing hanger in the B embodiment. Annulus valve 72 is preferably provided within the tubing hanger body, and controls flow between the annulus surrounding the production tubing string and the passageways 74 in the annulus block 24. The annulus block 24 shown in the A embodiment includes an upper port for fluid communication with crossover line 84, and a lower port for fluid communication with annulus line 82. Another annulus isolation valve 76 is preferably provided in the block 24 between the workover line 84 and the annulus line 82.

During the operation of flow test as shown in FIG. A1, the valve 44 is open and all the other valves depicted are closed, so that a flow test may be conducted from the running string which carried the tubing hanger running tool 52 in position and the production tubing string 22. The flow test operation thus allows fluid to flow through the central bore of the tree, and conventional tests may be conducted to ensure that each of the depicted valves is closed.

Referring to FIG. A2, the components are positioned for flushing the running string. Since the valve 44 is closed and the production valve 38 is open, fluid may be forced horizontally out spool 12 and against closed valve 40. The crossover valve 42 is open, as is annulus valve 72, while annulus isolation valve 76 is closed. Fluid flowing along the crossover flow path thus is in communication with the annulus between the production tubing and the wellhead. Since the workover valve 32 is open, fluid communication from below the tubing hanger and the annulus surrounding the production tubing string to above the tubing hanger is permitted, thereby allowing communication to the choke and kill line 56. Fluid communication between the central bore in the tree, the interior of the running string and one or more choke and kill lines permits flushing the running string. In an alternate procedure, the running tool may be lifted off the tubing hanger when flushing the running string, thereby, avoiding flow through the valve 32.

In FIG. A3, the tree cap and first and second closure members are positioned as previously discussed, and all valves are closed except for annulus isolation valve 76, the crossover valve 42 and isolation valve 40. Accordingly, fluid flow is permitted along the line 82, past the valve 76, along the line 84, through the crossover valve 42, through the isolation valve 40, then through the production line 86.

FIG. A4 depicts the components during conventional production flow following removal of the running tool 52 and installation of the tree cap 50, i.e., production flow from the tubing string through the valve 44, through the production valve 38 and the isolation valve 40, and out the production line 86. The remaining valves or plugs are closed. FIG. 4 also shows the tree assembly arranged for production flow with the first closure member 46, the tree cap 50, and the second closure member 48 discussed above in place. During crossover production, as shown in FIG. A6, production is through the subsurface valve 44 and the production valve 38, but the isolation valve 40 is closed and the crossover valve 42 and valve 76 are opened. The annulus isolation valve 76 remains open so that production can be obtained through the annulus line 82. During gas lift production flow as shown in FIG. A5, the valves remain as in the A4 configuration except that both the annulus valve 72 and the annulus isolation valve 76 are now open, so that gas can flow from line 82 past these valves and into the annulus surrounding the production tubing, thereby cooperating with the production tubing sliding sleeve 47 to obtain gas lift production flow.

FIG. A7 depicts the position of the valves during a workover operation, which may not require the use of a choke and kill line. In a workover operation, the running tool 52 may be lowered into position on a workstring, and communication is established between the tubing hanger, past the open valve 44, and the formation, and also between the formation, past the valve 32 and to the choke and kill line. Reverse fluid flow may also be practiced. The other valves remain closed during the workover operation.

The second and third embodiment as shown in figure designations B and C are similar to the embodiment shown with the A designation, and accordingly only the difference will be discussed below. In the FIG. B embodiment, the annulus port 70 is provided above rather than below the tubing hanger 20. In this arrangement, the bore in the BOP stack is thus always in communication with the annulus port 70, and valves 72 and 76 control flow, as discussed above. All the valves including the subsurface safety valve 44 thus remain closed during a flow test, as shown in FIG. B1. To flush the running string, the valves are positioned as shown in FIG. B2, which is the same position as FIG. A2, except now the workover valve 32 is closed and the annulus valve 72 is open. Fluid communication between the choke and kill line 56 and the interior of the tree above the safety valve allows flushing of the running string. In the second embodiment, the annulus port 70 is thus positioned above the tubing hanger, but the position of the various valves is the same as the first embodiment when flushing flow lines as shown in FIG. B3, and during normal production flow as shown in FIG. B4. During gas lift production flow, the valves 72 and 76 as shown in FIG. B5 are open, but for this embodiment the workover valve 32 is also open since the annulus port is above rather than below the tubing hanger. During crossover production flow for the second embodiment as shown in FIG. B6, the valves are positioned as for the first embodiment. During workover as shown in FIG. B7, the running line is in fluid communication with the tubing string and thus the formation, and the annulus surrounding the tubing string is in fluid communication with the choke and kill line 56, since the valve 32 is open.

Comparing the first embodiment to the third embodiment, the third embodiment includes a choke and kill line 56 in continuous communication with the crossover line 84, which adds a third lateral port 71 in the spool body. During flow test as shown in FIG. C1, the valves are positioned the same as the first embodiment. When flushing the running string as shown in FIG. C2, the workover valve 32 is closed. Since the workover port is provided above the tubing hanger, the running string may be flushed with both the workover valve 32 and the annulus valve 72 closed. To flush the flow lines as shown in FIG. C3, the valves and plugs are positioned as with the first embodiment, but in this case the workover valve 32 is open and both the annulus valve 72 and the annulus isolation valve 76 are open. FIGS. C4 and C5 illustrate conventional production and gas lift production for this third embodiment, with the valves positioned the same as in the A embodiment. During production crossover flow as shown in FIG. C6, the workover valve 32 is opened, and both the annulus valve 72 and the annulus isolation valve 76 are open. During workover as shown in FIG. C7, both the workover valve 32 and the safety valve 44 are open, and the other valves are closed.

The valve 32 which controls flow of the fluid in the workover passageway through the tubing hanger is preferably provided physically within the body of the tubing hanger, but in alternative embodiments could be provided on top of or below the tubing hanger. The valve preferably is a ball valve which is capable of sealing pressure either above or below the workover passageway, and a preferable ball valve as disclosed in U.S. application Ser. No. 10/071,650 filed on Feb. 8, 2002.

The second embodiment as disclosed in FIGS. B1–B7 has a disadvantage over the first and third embodiments in that, during a gas lift operation, the valve 32 is open for gas flowing through the valve. Fluid flow through the valve 32 may not be desired, since fluid flow will inherently wear the sealing components of the valve. Also, the second embodiment during a gas lift operation provides only one barrier above the tubing hanger, that is the barrier provided by the wireline plug in the tree cap, and two barriers are preferred for most applications. The C embodiment has a disadvantage over the A embodiment in that both a lateral annulus port and a lateral crossover port are provided in the spool body, which then requires the use of additional valves to obtain the desired two barriers. The A embodiment has only two lateral ports through the spool tree: the production port which inherently makes the tree a horizontal tree, and has the annulus port, and two barriers are continuously provided for containing fluid within the tree.

In each embodiment shown the figures, the production valve was positioned within the spool body. Less desirably, the production valve could be positioned exterior of the spool body while still controlling flow along the lateral port 36. Many applications will include the use of a safety valve as discussed along the production tubing string, but the position and type of a valve are not important to the concept of the invention. Wireline plugs are suitable first and second closure members as discussed above for sealing the bore within the tubing hanger and the bore tree cap, respectively, although other types of closure members will be apparent to those skilled in the art.

In a preferred embodiment, the spool body central bore axis is essentially the same as the BOP bore, and the bore in the tubing hanger is substantially coaxial with the central bore in the spool body. In other embodiments, the upper end of the bore in the spool body may move off the central axis for cooperation with a similarly configured throughport in a running tool, which would allow the diameter of the workover passageway in the tubing hanger to be increased. The terms "axially extending" or "extending axially" mean, with respect to a bore, that a component of the bore axis is parallel to the central (vertical) axis of the tree, although the bore axis may be inclined from the vertical.

The foregoing disclosure and description of the invention is illustrative and explanatory of preferred embodiments. It would be appreciated by those skilled in the art that various changes in the size, shape of materials, as well in the details of the illustrated construction or combination of features discussed herein maybe made without departing from the spirit of the invention, which is defined by the following claims.

What is claimed is:

1. A horizontal spool tree assembly for supporting a production tubing string within a well, the tree assembly adapted for use with a workover string for fluid communication with the tree assembly, the tree assembly comprising:

a spool body defining a spool body central bore for receiving therein a tubing hanger and a spool body production passageway extending laterally from the spool body central bore to a production valve positioned within the spool body;

the tubing hanger sealed to the spool body and adapted for supporting the production tubing therefrom, the tubing hanger having a tubing hanger bore in fluid communication with the production tubing string and a tubing hanger production passageway extending laterally from the tubing hanger bore for fluid communication with the lateral production passageway in the spool body;

an annulus port extending laterally through the spool body and in fluid communication with an annulus about the production tubing string;

an annulus valve for controlling fluid flow through the annulus port;

a workover flow path spaced from the tubing hanger bore and extending axially through the tubing hanger from the spool body central bore below the tubing hanger to the spool body central bore above the tubing hanger, thereby providing fluid communication between the workover string and the annulus surrounding the production tubing string; and a workover valve positioned along the workover flow path for controlling fluid flow between the central bore above the tubing hanger and the annulus below the tubing hanger.

2. A tree assembly as defined in claim 1, further comprising:

a crossover flow line extending from a crossover port in fluid communication with the annulus port to the production valve; and a crossover valve for controlling fluid flow along the crossover flow line.

3. A tree assembly as defined in claim 1, further comprising:

a safety valve positioned along the production tubing string below the tubing hanger.

4. A tree assembly as defined in claim 1, further comprising:

a first closure member positioned within the bore in the tubing hanger.

5. A tree assembly as defined in claim 4, further comprising:

a second closure member positioned above the tubing hanger and the first closure member for isolating a bore between the first and second closure members.

6. A tree assembly as defined in claim 1, further comprising:

a first closure member within the central bore in the tubing hanger; and a second closure member positioned above the first closure member.

7. A tree assembly as defined in claim 1, wherein the spool body central bore and the tubing hanger bore each have a substantially coaxial axis.

8. A tree assembly as defined in claim 1, wherein the tree assembly is subsea, and the one or more control lines extend from a BOP to the surface, and the workover string extends from the tree assembly to the surface.

9. A horizontal spool tree assembly as defined in claim 1, wherein the workover valve is controllable to stop fluid flow in either direction along the workover flow path in the tubing hanger.

10. A horizontal spool tree assembly as defined in claim 1, wherein the annulus port is below a seal between the tubing hanger and the spool body.

11. A horizontal spool tree assembly as defined in claim 10, wherein a crossover port extends laterally through the tool body above the seal between the tubing hanger and the spool body.

12. A horizontal spool tree assembly as defined in claim 1, wherein the annulus port is above a seal between the tubing hanger and the spool body.

13. A horizontal spool tree assembly as defined in claim 10, wherein a crossover port extends laterally through the tool body above the seal between the tubing hanger and the spool body.

14. A horizontal spool tree assembly as defined in claim 10, wherein a crossover port extends laterally through the tool body above the seal between the tubing hanger and the spool body.

15. A horizontal spool tree assembly as defined in claim 12, wherein the annulus port is above a seal between the tubing hanger and the spool body.

16. A horizontal spool tree assembly for supporting a production tubing string within a well, the tree assembly adapted for use with a workover string for fluid communication with the tree assembly, the tree assembly comprising:

a spool body defining a spool body central bore for receiving therein a tubing hanger and a spool body production passageway extending laterally from the spool body central bore to a production valve;

the tubing hanger being sealed to the spool body and adapted for supporting the production tubing therefrom, the tubing hanger having a tubing hanger bore in fluid communication with the production tubing string and a tubing hanger production passageway extending laterally from the tubing hanger bore for fluid communication with the lateral production passageway in the spool body, the spool body central bore and the tubing hanger bore axes being substantially aligned;

an annulus port extending laterally through the spool body and in fluid communication with an annulus about the production tubing string;

an annulus valve for controlling fluid flow through the annulus port;

a workover flow path spaced from the tubing hanger bore and extending axially entirely within the tubing hanger from the spool body central bore below the tubing hanger to the spool body central bore above the tubing hanger, thereby providing fluid communication between the central bore above the tubing hanger and the annulus surrounding the production tubing string; and a workover valve positioned along the workover flow path for controlling fluid flow both from the central bore above the tubing hanger to the annulus below the tubing hanger and from the annulus below the tubing hanger to the central bore above the tubing hanger.

17. A tree assembly as defined in claim 16, further comprising:

a crossover flow line extending from a crossover port in fluid communication with the annulus port to the production valve; and a crossover valve for controlling fluid flow along the crossover flow line.

18. A tree assembly as defined in claim 16, wherein the production valve is positioned within the spool body.

19. A tree assembly as defined in claim 16, further comprising:

a safety valve positioned along the production tubing string below the tubing hanger.

20. A tree assembly as defined in claim 16, further comprising:

a first closure member positioned within the bore in the tubing hanger.

21. A tree assembly as defined in claim 20, further comprising:

a second closure member positioned above the tubing hanger and the first closure member.

22. A tree assembly as defined in claim 16, further comprising:

a first closure member within the central bore in the tubing hanger; and a second closure member positioned above the first closure member the first closure member for isolating a bore in the BOP.

23. A tree assembly as defined in claim 16, wherein the tree assembly is subsea, and the one or more control lines extend from a BOP to the surface, and the workover string extends from the tree assembly to the surface.

24. A horizontal spool tree assembly as defined in claim 16, wherein the annulus port is below a seal between the tubing hanger and the spool body.

25. A horizontal spool tree assembly as defined in claim 16, wherein the annulus port is above a seal between the tubing hanger and the spool body.

26. A subsea horizontal spool tree assembly for supporting a production tubing string within a well, the tree assembly adapted for use with a workover string for fluid communication with the tree assembly, the tree assembly comprising:

a spool body defining a spool body central bore for receiving therein a tubing hanger and a spool body production passageway extending laterally from the spool body central bore to a production valve;

the tubing hanger being sealed to the spool body and adapted for supporting the production tubing therefrom, the tubing hanger having a tubing hanger bore in fluid communication with the production tubing string and a tubing hanger production passageway extending laterally from the tubing hanger bore for fluid communication with the lateral production passageway in the spool body;

an annulus port extending laterally through the spool body and in fluid communication with an annulus about the production tubing string;

an annulus valve for controlling fluid flow through the annulus port;

a workover flow path spaced from the tubing hanger bore and extending axially entirely within the tubing hanger from the spool body central bore below the tubing hanger to the spool body central bore above the tubing hanger, thereby providing fluid communication between the central bore above the tubing hanger and the annulus surrounding the production tubing string; and a workover valve positioned along the workover flow path for controlling fluid flow both between the central bore above the tubing hanger and the annulus below the tubing hanger.

27. A tree assembly as defined in claim 26, further comprising:

a crossover flow line extending from a crossover port in fluid communication with the annulus port to the production valve; and a crossover valve for controlling fluid flow along the crossover flow line.

28. A tree assembly as defined in claim 26, further comprising:

a first closure member within the central bore in the tubing hanger; and a second closure member positioned above the first closure member.

29. A horizontal spool tree assembly as defined in claim 26, wherein the annulus port is below a seal between the tubing hanger and the spool body.

30. A method of supporting a production tubing string within a well from a tree assembly adapted for use with a workover string for fluid communication with the tree assembly, the method comprising:

positioning a spool body defining a spool body central bore for receiving therein a tubing hanger and a spool body production passageway extending laterally from the spool body central bore to a production valve positioned within the spool body;

sealing the tubing hanger to the spool body and adapted for supporting the production tubing therefrom, the tubing hanger having a tubing hanger bore in fluid communication with the production tubing string and a tubing hanger production passageway extending laterally from the tubing hanger bore for fluid communication with the lateral production passageway in the spool body;

providing an annulus port extending laterally through the spool body and in fluid communication with an annulus about the production tubing string;

providing an annulus valve for controlling fluid flow through the annulus port;

forming a workover flow path spaced from the tubing hanger bore and extending axially through the tubing hanger from the spool body central bore below the tubing hanger to the spool body central bore above the tubing hanger, thereby providing fluid communication between the workover string and the annulus surrounding the production tubing string; and positioning a workover valve along the workover flow path for controlling fluid flow both between the central bore above the tubing hanger and the annulus below the tubing hanger.

31. A method as defined in claim 30, further comprising:

a crossover flow line extending from a crossover port in fluid communication with the annulus port to the production valve; and a crossover valve for controlling fluid flow along the crossover flow line.

32. A method as defined in claim 30, further comprising:

positioning a safety valve along the production tubing string below the tubing hanger.

33. A method as defined in claim 30, further comprising:

positioning a first closure member within the bore in the tubing hanger.

34. A method as defined in claim 33, further comprising:

a second closure member positioned above the tubing hanger and the first closure member.

35. A method as defined in claim 30, wherein the tree assembly is subsea, and the one or more control lines extend from a BOP to the surface, and the workover string extends from the tree assembly to the surface.

36. A method as defined in claim 30, wherein the annulus port is positioned below a seal between the tubing hanger and the spool body.

37. A method as defined in claim 36, wherein a crossover port extends laterally through the tool body above the seal between the tubing hanger and the spool body.

38. A method as defined in claim 30, wherein the annulus port is positioned above a seal between the tubing hanger and the spool body.

39. A method as defined in claim 30, further comprising:

closing the production valve, the annulus valve, the workover valve, and a safety valve along the production tubing string to flow test the tree assembly.

40. A method as defined in claim 30, further comprising:

closing the production valve, the annulus valve, and the workover valve to flush flow lines.

41. A method as defined in claim 30, further comprising:

opening the annulus valve and the production valve to inject gas through the annulus port for gas lift production flow, with the workover valve being closed.

42. A method as defined in claim 30, further comprising:

a crossover flow line extending from a crossover port in fluid communication with the annulus port to the production valve;

a crossover valve for controlling fluid flow along the crossover flow line;

closing the annulus valve, opening the crossover valve, and opening the production valve for production crossover flow.

43. A method as defined in claim 30, further comprising:

fluidly connecting the interior of a running string with the bore in the tubing hanger, closing the annulus valve and the production valve, and opening the workover valve for a workover operation.

44. A horizontal spool tree assembly for supporting a production tubing string within a well, the tree assembly adapted for use with a workover string for fluid communication with the tree assembly, the tree assembly comprising:

a spool body defining a spool body central bore for receiving therein a tubing hanger and a spool body production passageway extending laterally from the spool body central bore to a production valve;

the tubing hanger sealed to the spool body and adapted for supporting the production tubing therefrom, the tubing hanger having a tubing hanger bore in fluid communication with the production tubing string and a tubing hanger production passageway extending laterally from the tubing hanger bore for fluid communication with the lateral production passageway in the spool body;

an annulus port extending laterally through the spool body and in fluid communication with an annulus about the production tubing string;

an annulus valve for controlling fluid flow through the annulus port;

a workover flow path spaced from the tubing hanger bore and extending axially through the tubing hanger from the spool body central bore below the tubing hanger to the spool body central bore above the tubing hanger, thereby providing fluid communication between the workover string and the annulus surrounding the production tubing string;

a workover valve positioned along the workover flow path for controlling fluid flow between the central bore above the tubing hanger and the annulus below the tubing hanger;

a first closure member positioned within the bore in the tubing hanger; and a second closure member positioned above the first closure member for isolating a bore between the first and second closure members.

45. A tree assembly as defined in claim 44, further comprising:

a crossover flow line extending from a crossover port in fluid communication with the annulus port to the production valve; and a crossover valve for controlling fluid flow along the crossover flow line.

46. A tree assembly as defined in claim 44, wherein the production valve is positioned within the spool body.

47. A tree assembly as defined in claim 44, further comprising:

a safety valve positioned along the production tubing string, below the tubing hanger.

48. A tree assembly as defined in claim 44, wherein the spool body central bore and the tubing hanger bore each have a substantially coaxial axis.

49. A tree assembly as defined in claim 44, wherein the tree assembly is subsea, and the one or more control lines extend from a BOP to the surface, and the workover string extends from the tree assembly to the surface.

50. A horizontal spool tree assembly as defined in claim 44, wherein the workover valve is controllable to stop fluid flow in either direction along the workover flow path in the tubing hanger.

51. A horizontal spool tree assembly as defined in claim 44, wherein the annulus port is below a seal between the tubing hanger and the spool body.

52. A horizontal spool tree assembly as defined in claim 51, wherein a crossover port extends laterally through the tool body above the seal between the tubing hanger and the spool body.

53. A horizontal spool tree assembly as defined in claim 44, wherein the annulus port is above a seal between the tubing hanger and the spool body.

54. A horizontal spool tree assembly as defined in claim 44, wherein the workover flow path extends axially entirely within the spool body.

55. A method of supporting a production tubing string within a well from a tree assembly adapted for use with a workover string for fluid communication with the tree assembly, the tree assembly comprising:

positioning a spool body defining a spool body central bore for receiving therein a tubing hanger and a spool body production passageway extending laterally from the spool body central bore to a production valve;

sealing the tubing hanger to the spool body and adapted for supporting the production tubing therefrom, the tubing hanger having a tubing hanger bore in fluid communication with the production tubing string and a tubing hanger production passageway extending laterally from the tubing hanger bore for fluid communication with the lateral production passageway in the spool body;

providing an annulus port extending laterally through the spool body and in fluid communication with an annulus about the production tubing string;

providing an annulus valve for controlling fluid flow through the annulus port;

forming a workover flow path entirely within the tubing hanger spaced from the tubing hanger bore and extending axially through the tubing hanger from the spool body central bore below the tubing hanger to the spool body central bore above the tubing hanger, thereby providing fluid communication between the workover string and the annulus surrounding the production tubing string; and positioning a workover valve along the workover flow path for controlling fluid flow both between the central bore above the tubing hanger and the annulus below the tubing hanger.

56. A method as defined in claim 55, further comprising:

a crossover flow line extending from a crossover port in fluid communication with the annulus port to the production valve; and a crossover valve for controlling fluid flow along the crossover flow line.

57. A method as defined in claim 55, wherein the production valve is positioned within the spool body.

58. A method as defined in claim 55, further comprising:

positioning a safety valve along the production tubing string below the tubing hanger.

59. A method as defined in claim 55, wherein the tree assembly is subsea, and the one or more control lines extend from a BOP tot he surface, and the workover string extends from the tree assembly to the surface.

60. A method as defined in claim 55, wherein the annulus port is positioned below a seal between the tubing hanger and the spool body.

61. A method as defined in claim 60, wherein a crossover port extends laterally through the tool body above the seal between the tubing hanger and the spool body.

62. A method as defined in claim 55, wherein the annulus port is positioned above a seal between the tubing hanger and the spool body.

63. A method as defined in claim 55, wherein the workover flow path is entirely within the spool body.

64. A method as defined in claim 55, further comprising:

closing the production valve, the annulus valve, the workover valve, and a safety valve along the production tubing string to flow test the tree assembly.

65. A method as defined in claim 55, further comprising:

closing the production valve, the annulus valve, and the workover valve to flush flow lines.

66. A method as defined in claim 55, further comprising:

opening the annulus valve and the production valve to inject gas through the annulus port for gas lift production flow, with the workover valve being closed.

67. A method as defined in claim 55, further comprising:

a crossover flow line extending from a crossover port in fluid communication with the annulus port to the production valve;

a crossover valve for controlling fluid flow along the crossover flow line;

closing the annulus valve, opening the crossover valve, and opening the production valve for production crossover flow.

68. A method as defined in claim 55, further comprising:

fluidly connecting the interior of a running string with the bore in the tubing hanger, closing the annulus valve and the production valve, and opening the workover valve for a workover operation.

69. A method as defined in claim 55, further comprising:

providing the workover flow path entirely within the tubing hanger from the central bore below the tubing hanger to the central bore above the tubing hanger.

70. A method of supporting a production tubing string within a well from a tree assembly adapted for use with a workover string for fluid communication with the tree assembly, the method comprising:

positioning a spool body defining a spool body central bore for receiving therein a tubing hanger and a spool body production passageway extending laterally from the spool body central bore to a production valve;

sealing the tubing hanger to the spool body and adapted for supporting the production tubing therefrom, the tubing hanger having a tubing hanger bore in fluid communication with the production tubing string and a tubing hanger production passageway extending laterally from the tubing hanger bore for fluid communication with the lateral production passageway in the spool body;

providing an annulus port extending laterally through the spool body and in fluid communication with an annulus about the production tubing string;

providing an annulus valve for controlling fluid flow through the annulus port;

forming a workover flow path entirely spaced from the tubing hanger bore and extending axially entirely within the tubing hanger from the spool body central bore below the tubing hanger to the spool body central bore above the tubing hanger, thereby providing fluid communication between the central bore above the tubing hanger and the annulus surrounding the production tubing string; and positioning a workover valve along the workover flow path for controlling fluid flow both between the central bore above the tubing hanger and the annulus below the tubing hanger.

71. A method as defined in claim 70, further comprising:

a crossover flow line extending from a crossover port in fluid communication with the annulus port to the production valve; and a crossover valve for controlling fluid flow along the crossover flow line.

72. A method as defined in claim 70, further comprising:

positioning a safety valve along the production tubing string below the tubing hanger.

73. A method as defined in claim 70, wherein the tree assembly is subsea, and the one or more control lines extend from a BOP tot he surface, and the workover string extends from the tree assembly to the surface.

74. A method as defined in claim 70, wherein the annulus port is positioned below a seal between the tubing hanger and the spool body.

75. A method as defined in claim 70, wherein the annulus port is positioned above a seal between the tubing hanger and the spool body.

76. A method as defined in claim 70, further comprising:

closing the production valve, the annulus valve, the workover valve, and a safety valve along the production tubing string to flow test the tree assembly.

77. A method as defined in claim 70, further comprising:

closing the production valve, the annulus valve, and the workover valve to flush flow lines.

78. A method as defined in claim 70, further comprising:

opening the annulus valve and the production valve to inject gas through the annulus port for gas lift production flow, with the workover valve being closed.

79. A method as defined in claim 70, further comprising:

fluidly connecting the interior of a running string with the bore in the tubing hanger, closing the annulus valve and the production valve, and opening the workover valve for a workover operation.

* * * * *

UNITED STATES PATENT AND TRADEMARK OFFICE

CERTIFICATE OF CORRECTION

PATENT NO. : 6,755,254 B2
DATED : June 29, 2004
INVENTOR(S) : Blake T. DeBerry

It is certified that error appears in the above-identified patent and that said Letters Patent is hereby corrected as shown below:

Column 9,
Lines 14, 21 and 24, delete “tool” and insert therefor -- spool --.

Column 12,
Line 12, delete “tool” and insert therefor -- spool --.

Column 13,
Line 41, delete “tool” and insert therefor -- spool --.

Column 14,
Line 34, delete “tool” and insert therefor -- spool --.

Signed and Sealed this

Twenty-second Day of March, 2005

JON W. DUDAS
*Director of the United States Patent and Trademark Office*